US011545009B2

(12) United States Patent
Sagawa et al.

(10) Patent No.: US 11,545,009 B2
(45) Date of Patent: Jan. 3, 2023

(54) MEDAL ARRANGEMENT DEVICE AND MEDAL GAME MACHINE

(71) Applicant: SEGA CORPORATION, Tokyo (JP)

(72) Inventors: Yuichiro Sagawa, Tokyo (JP); Akira Hanamata, Tokyo (JP)

(73) Assignee: SEGA CORPORATION, Tokyo (JP)

( * ) Notice: Subject to any disclaimer, the term of this patent is extended or adjusted under 35 U.S.C. 154(b) by 0 days.

(21) Appl. No.: 17/688,086

(22) Filed: Mar. 7, 2022

(65) Prior Publication Data

US 2022/0284780 A1 Sep. 8, 2022

(30) Foreign Application Priority Data

Mar. 8, 2021 (JP) ..... JP2021-036753

(51) Int. Cl.
*G07F 17/32* (2006.01)

(52) U.S. Cl.
CPC ..... *G07F 17/3297* (2013.01)

(58) Field of Classification Search
CPC ... G07F 17/3297; G07F 17/32; G07F 17/3286
See application file for complete search history.

(56) References Cited

U.S. PATENT DOCUMENTS

2006/0183553 A1* 8/2006 Kiriyama ..... G07F 17/3216 463/46
2013/0069303 A1* 3/2013 Hasegawa ..... G07F 17/3213 273/138.1
2017/0092077 A1* 3/2017 Lim ..... G07F 17/3297
2020/0188771 A1* 6/2020 Sasaki ..... G07F 1/02
2020/0188773 A1* 6/2020 Sasaki ..... A63F 9/28
2020/0193781 A1* 6/2020 Kawai ..... G07F 17/3297

FOREIGN PATENT DOCUMENTS

JP 11076503 A * 3/1999 ..... A63F 7/027
JP 2016077810 5/2016

* cited by examiner

*Primary Examiner* — Raleigh W Chiu
(74) *Attorney, Agent, or Firm* — Sterne, Kessler, Goldstein & Fox P.L.L.C.

(57) ABSTRACT

A medal arrangement device and a medal game machine are disclosed. A medal arrangement device has a holder and a supplier with a medal hopper and a guide unit. A medal passage has a first medal passage part and a second medal passage part. The guide has an upstream abutting part and a downstream abutting part provided on a first side wall surface side of the first medal passage part. When one medal ejected from the medal hopper reaches a predetermined position of the downstream end portion, at least a part of the upstream abutting part and at least a part of the downstream abutting part are located in the first medal passage part to press the medal against the second side wall surface. When the medal passes through the predetermined position, the downstream abutting part retracts to an outside of the first medal passage part.

11 Claims, 30 Drawing Sheets

MEDAL ARRANGEMENT DEVICE AND MEDAL GAME MACHINE

BACKGROUND

Field

The present invention relates to a medal arrangement device and a medal game machine capable of realizing miniaturization while reducing costs, and stably and quickly supplying and stacking medals.

Description of Related Art

Currently, a medal game machine is known having a configuration in which a player inserts a medal onto a field, a pusher that reciprocates on the field presses and drops the medal, and the dropped medal is paid out to the player. As a medal arrangement device incorporated in such a medal game machine, a device is disclosed having a configuration in which medals stocked in a stocker are taken out one by one through a take-out hole of a rotating plate, transferred in a rotation direction, and supplied to one of the medal holes at a predetermined position, and such taking-out and transferring of the medals are repeated such that medals M can be fitted into all of the medal holes (Japanese Patent Application Laid-Open No. 2016-077810). It is said that, by adopting such a medal arrangement device, medals can be easily and quickly fitted.

SUMMARY

However, the conventional medal arrangement device disclosed in Japanese Patent Application Laid-Open No. 2016-077810 requires a certain amount of time for disposing the medals in an annular shape, and thus, it can be said that the medals can be stacked so quickly. In addition, since the configuration and transport operation for transporting medals are complicated, not only the manufacturing costs are high, but also there is a possibility that the medals are clogged in the device when the medals are transported. Furthermore, in the conventional medal arrangement device, the medal slides down from the stocker to the rotating plate through an inclined medal passage. Accordingly, the entire device is enlarged in order to ensure a space for installing the inclined medal passage, and the medal slides down to the rotating plate due to its own weight. Thus, there is a possibility that large variations are generated in the direction, speed, and posture of sliding-down due to individual differences of the medals, and as a result, the supplier of medals will become unstable, which causes a large impact on the stacking.

The present invention has been made in view of such circumstances, and an object of the present invention is to provide a medal arrangement device and a medal game machine capable of realizing miniaturization while reducing the costs, and stably and quickly supplying and stacking medals.

In order to achieve the above-described object, according to the present invention, there is provided a medal arrangement device including: a holder having a holding surface for holding a single-layer medal set configured with a plurality of medals disposed in a predetermined arrangement; and a supplier supplying the medals to the holding surface via a medal passage, in which the supplier has a medal hopper ejecting the medals one by one into the medal passage, and a guide unit guiding the medals ejected into the medal passage, the medal passage has a first medal passage part formed on an upstream side of the holding surface in a moving direction of the medal and having a first side wall surface and a second side wall surface facing each other, and a second medal passage part connected to a downstream end portion of the first medal passage part and formed on the holding surface, the guide unit has an upstream abutting part and a downstream abutting part, both the upstream abutting part and the downstream abutting part are movable and are provided on a first side wall surface side of the first medal passage part so as to be urged toward the second side wall surface, and the upstream abutting part and the downstream abutting part are provided so that: when one medal ejected from the medal hopper reaches a predetermined position of the downstream end portion, at least a part of the upstream abutting part and at least a part of the downstream abutting part are located in the first medal passage part so as to press the medal against the second side wall surface; and when the medal passes through the predetermined position, the downstream abutting part retracts to an outside of the first medal passage part.

When such a configuration is adopted, as the upstream abutting part and the downstream abutting part of the guide unit press the medal against the second side wall surface at a predetermined position on the upstream side of the holding surface to slightly suppress the movement of the medal, it is possible to control the moving state of the medals and improve the measurement accuracy of the number of medals supplied to the holding surface. After this, when the medals pass through a predetermined position, the downstream abutting part retracts to the outside of the first medal passage part, and accordingly, the load on the medals is released and the medals are allowed to move such that the supplying speed of the medals can be maintained. As a result, it becomes possible to obtain a medal arrangement device capable of stably and quickly supplying and disposing the medals.

Further, the occupying area of the configuration in which a part of the medal passage is disposed on the holding surface is smaller than that of the configuration in which a part of the medal passage is disposed around the holding surface, and thus, miniaturization and simplification of the device can be realized. Accordingly, it is possible to obtain a medal arrangement device that can realize miniaturization while reducing the costs.

In the medal arrangement device according to the present invention, the downstream abutting part may be interlocked with movement in a width direction of the first medal passage part of the upstream abutting part.

When adopting such a configuration, the operation of the upstream abutting part and the downstream abutting part can be easily controlled.

In the medal arrangement device according to the present invention, the guide unit may have a first guider, the first guider may have a first abutting part having a lever structure, the first abutting part may have a fulcrum fixed to the first side wall surface side of the first medal passage part and a free end provided on a downstream end portion side, the upstream abutting part and the downstream abutting part may be provided at the free end of the first abutting part, and the downstream abutting part may be provided so as to rotate around the fulcrum in a direction away from the first medal passage part or a direction approaching the first medal passage part as a position where the upstream abutting part contacts a side surface of the medal changes.

When adopting such a configuration, it is possible to control the operation of the downstream abutting part by using a simple configuration.

In the medal arrangement device according to the present invention, both the upstream abutting part and the downstream abutting part may be configured with rollers, and a shortest distance between the upstream abutting part and the downstream abutting part may be less than a diameter of one medal.

When adopting such a configuration, the frictional force occurred when the upstream abutting part and the downstream abutting part abut against the medal can be reduced, and the movement of the medal can be reliably suppressed at a predetermined position.

In the medal arrangement device according to the present invention, the second medal passage part may be an annular passage part formed along a circumferential direction of the holding surface, and the medals may be disposed on the holding surface while filling the annular passage part.

When adopting such a configuration, the holding surface can form a part of the second medal passage part, and thus, the configuration of the second medal passage part can be simplified.

In the medal arrangement device according to the present invention, the guide unit may further have a second guider which is provided at a center of the holding surface intersecting the holding surface and guides the medals so as to define a traveling direction of the medal in the annular passage part.

When adopting such a configuration, the traveling direction of the medals in the annular passage part can be defined (for example, defined as the clockwise direction) by the second guider, and thus, the traveling of the medals in different directions in the annular passage part can be suppressed. Therefore, the medals can stably fill the annular passage part.

In the medal arrangement device according to the present invention, the second guider may have a protrusion provided in the annular passage part so as to face the downstream end portion of the first medal passage part, and a distance between a tip end of the protrusion and a most downstream end of the first side wall surface may be equal to or greater than a diameter of one medal, and a distance between the tip end of the protrusion and a most downstream end of the second side wall surface may be less than the diameter of one medal.

When adopting such a configuration, it is possible to define the traveling direction of the medal in the annular passage part by using a simple configuration.

In the medal arrangement device according to the present invention, the guide unit may further have a third guider having a guide plate and provided above the second medal passage part so as to cover at least a part of the second medal passage part, and a distance between a surface of the guide plate facing the holding surface and the holding surface may be greater than a thickness of one medal and less than a thickness of two medals.

When adopting such a configuration, it is possible to suppress occurrence of clogging of the medals in the second medal passage part by restricting the movement of the medal in the thickness direction during the movement.

In the medal arrangement device according to the present invention, the guide unit may further have an actuator that moves the third guider in a range from a position where the third guider covers the second medal passage part to a position where the third guider does not cover the second medal passage part.

When adopting such a configuration, it is possible to adjust the position of the third guider with respect to the second medal passage part as necessary, and to improve the degree of freedom in using the third guider.

In the medal arrangement device according to the present invention, a mounter having a mounting surface on which the single-layer medal set or a medal tower configured with plural layers of the single-layer medal sets is mounted; and a transporter raising or lowering the holder in a range from a position above the mounting surface to a position below the first medal passage part, may further be provided.

When adopting such a configuration, the medal tower can be formed and mounted by using a simple configuration.

According to the present invention, there is provided a medal game machine including: a medal feeder feeding medals; a mounting table on which the medals fed are mounted; a pusher table for moving the medals mounted on the mounting table; a winning port for the medals dropped from the mounting table entering; and the above-described medal arrangement device.

By adopting such a configuration, it is possible to provide a medal game machine capable of stably and quickly supplying and disposing the medals and reducing the costs.

According to the present invention, it is possible to provide a medal arrangement device and a medal game machine capable of realizing miniaturization while reducing the costs, and stably and quickly supplying and stacking the medals.

DETAILED DESCRIPTION

Figure 1:
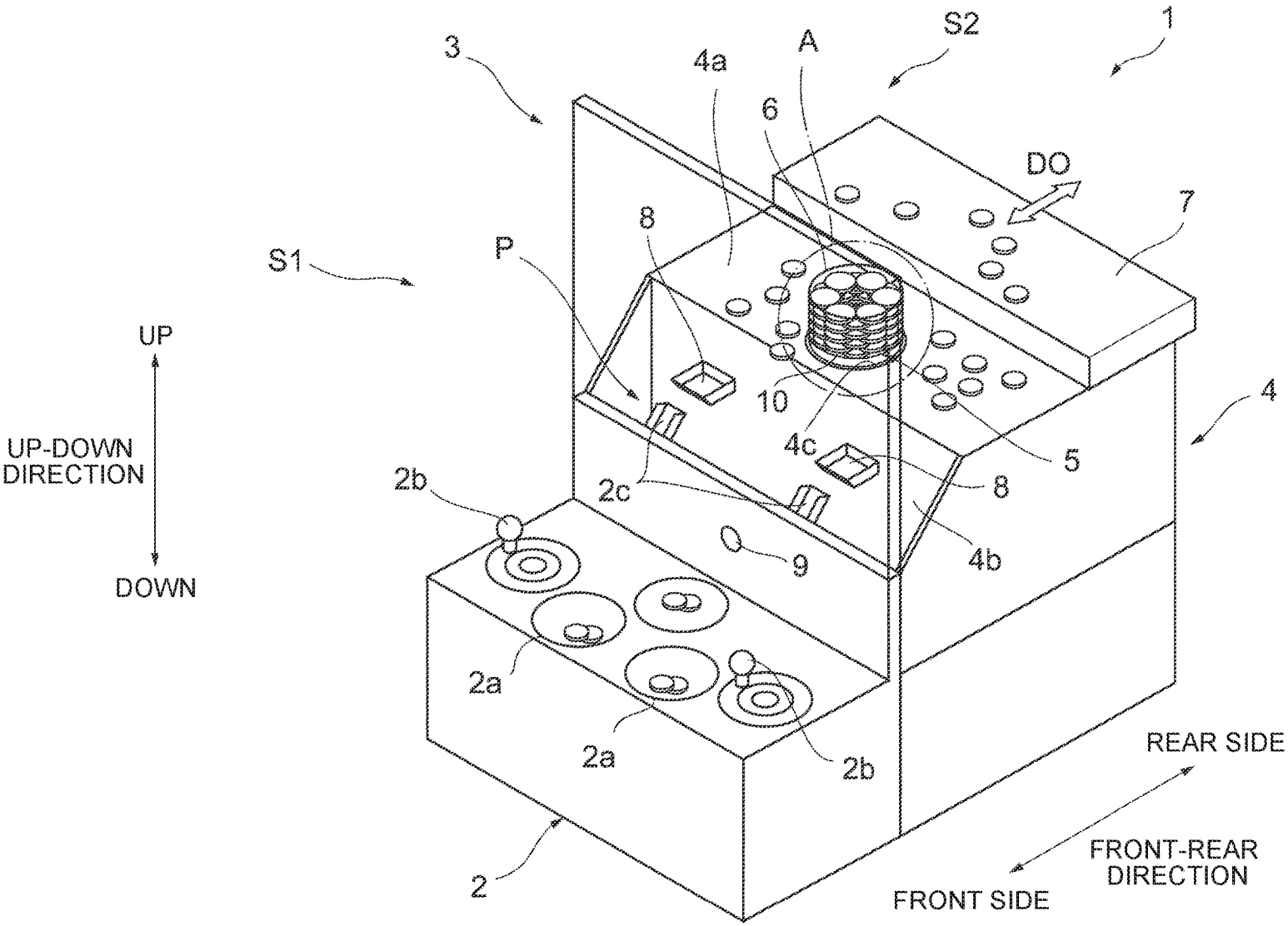
FIG. 1 is a perspective view illustrating a configuration of a medal game machine according to the present embodiment.

Hereinafter, the present embodiment will be described with reference to each drawing. Unless otherwise specified, the positional relationship such as up, down, left, and right of the drawings is based on the positional relationship illustrated in the drawing. In addition, the dimensional ratio of the drawing is not limited to the ratio illustrated in the drawings. Furthermore, the following embodiments are examples for describing the present invention, and are not intended to limit the present invention only to the embodiments. Further, the present invention can be modified in various manners as long as the modification does not deviate from the gist of the present invention.

Medal Game Machine

Figure 2:
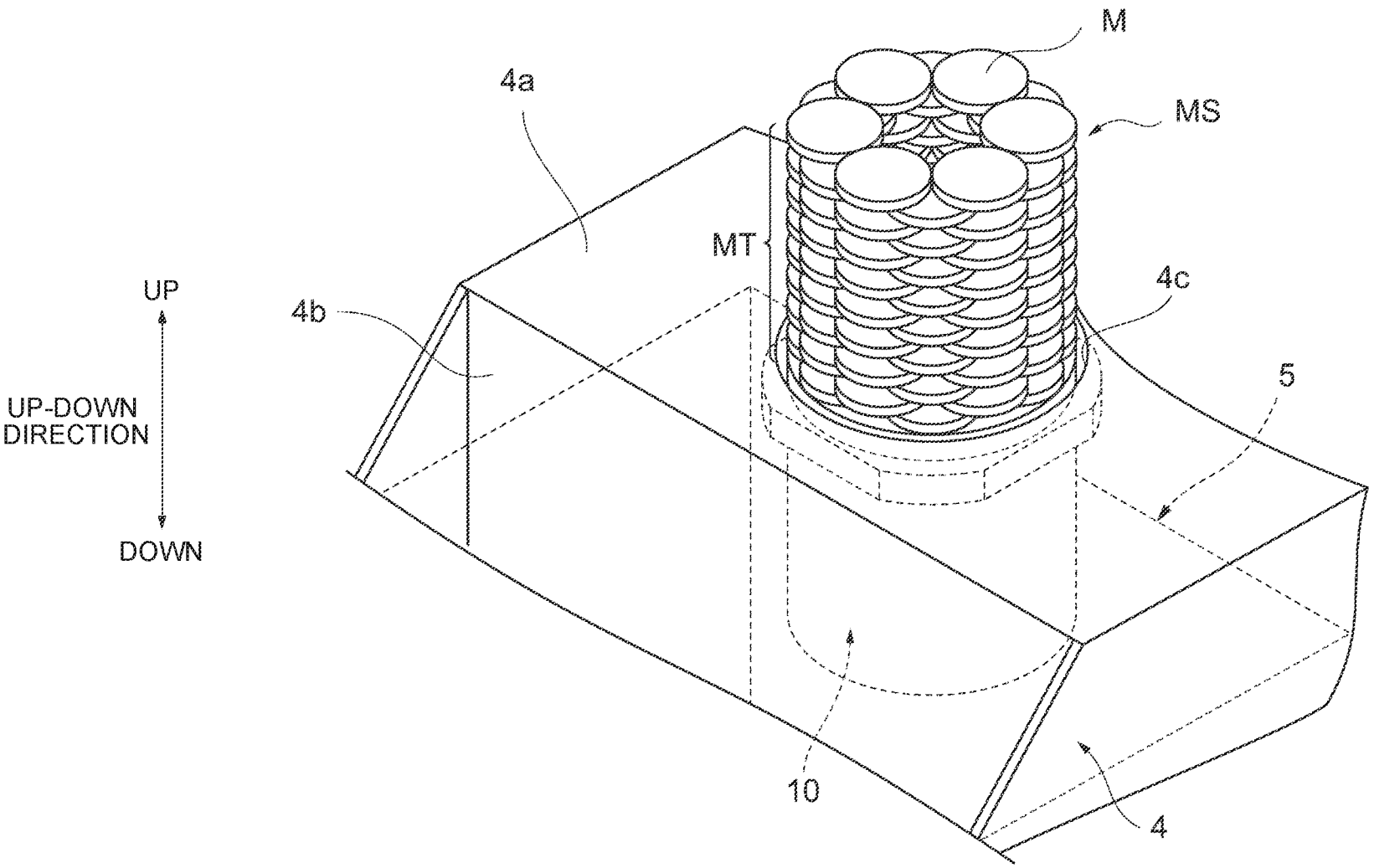
FIG. 2 is an enlarged view of a part A of FIG. 1.
Figure 3:
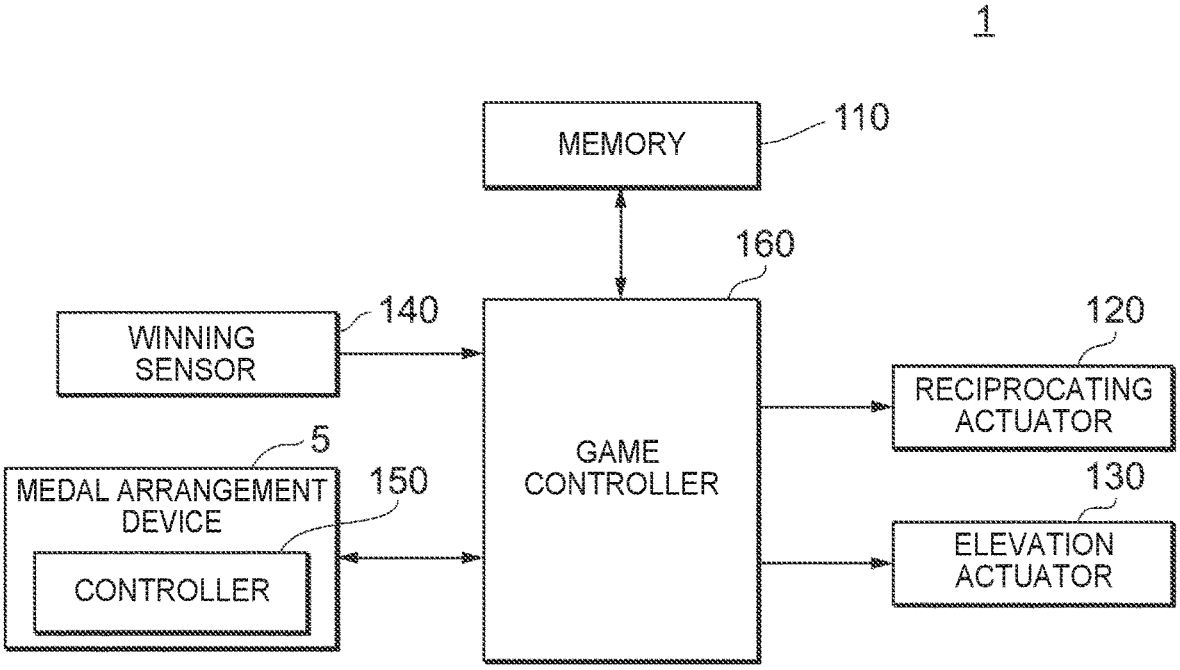
FIG. 3 is a block diagram for describing a functional configuration of the medal game machine according to the present embodiment.

First, a configuration of a medal game machine 1 according to the present embodiment will be described with reference to FIGS. 1 to 3. FIG. 1 is a perspective view of the medal game machine 1. FIG. 2 is an enlarged view of a part A of FIG. 1. FIG. 3 is a block diagram for describing a functional configuration of the medal game machine 1. In FIG. 2, the display of a medal protection wall 6 will be omitted.

The medal game machine 1 according to the present embodiment is an example of a device for playing a medal game. As illustrated in FIG. 1, the medal game machine 1 includes an operation space S1 on a front side for a player to perform an insertion operation of a medal M, and a game space S2 on a rear side for creating a medal tower, in a front-rear direction.

Further, as illustrated in FIG. 1, the medal game machine 1 includes a medal feeder 2 disposed in the operation space S1; a partition portion 3 for partitioning the operation space S1 and the game space S2; a mounting table 4, which is disposed in the game space S2 and on which the medals M are mounted; a medal arrangement device 5 for creating the medal tower; a transparent medal protection wall 6 for preventing an incomplete medal tower from collapsing; a pusher table 7 for moving the medals M on the mounting table 4; a winning port 8 for the medals M dropped from the mounting table 4 entering; and a payout port 9 for paying out the dropped medals M.

Further, as illustrated in FIG. 3, the medal game machine 1 includes: a memory 110 for storing various data; a reciprocating actuator 120 for reciprocating the pusher table 7; an elevation actuator 130 for raising or lowering the medal protection wall 6; a winning sensor 140 for detecting that whether the medal M has entered the winning port 8; a controller 150 that controls the operation of the medal arrangement device 5; and game controller 160 for controlling the configuration of each actuator and the like and a game based on information from the winning sensor 140 and the controller 150.

The medal feeder 2 includes a medal insertion port 2*a*, a handle 2*b*, and a medal ejection port 2*c*. At the time of the game, the player inserts the medal M into the medal insertion port 2*a* and then turns the handle 2*b* to make it possible to eject the medal M in the medal insertion port 2*a* from the medal ejection port 2*c* to the mounting table 4 by an urging force of a spring or the like.

The mounting table 4 includes a mounting surface 4*a* on which the medals M ejected from the medal ejection port 2*c* are mounted; a side wall 4*b* on a front side; and a hole portion 4*c* formed on the mounting surface 4*a*. Further, in the game space S2, a drop port P is provided on the front side of the side wall 4*b* of the mounting table 4.

The medal arrangement device 5 is provided on the front side of the mounting table 4. Specifically, as illustrated in FIG. 2, the medal arrangement device 5 is disposed inside the mounting table 4 such that the mounting surface 111 of the medal arrangement device 5, which will be described later, can be exposed from the hole portion 4*c* of the mounting surface 4*a*. The details of the medal arrangement device 5 will be described later.

The medal protection wall 6 is provided around the mounter 10 of the medal arrangement device 5 in the hole portion 4*c* such that the medal protection wall 6 can be raised and lowered with respect to the mounting surface 4*a* by the elevation actuator 130. In a case where the medal tower is incomplete during the game, the medal protection wall 6 is raised above the mounting surface 4*a*, and thus, the incomplete medal tower can be prevented from collapsing due to the pressing of the moving medals M. In a case where the medal tower is completed, the medal protection wall 6 is lowered below the mounting surface 4*a*, and thus, the medal tower can be collapsed.

The pusher table 7 is movably provided above the mounting surface 4*a* and on the rear side of the medal protection wall 6. Further, the pusher table 7 reciprocates in a D0 direction by driving the reciprocating actuator 120. The reciprocating width of the pusher table 7 can be changed.

The winning port 8 is provided on the side wall 4*b* of the mounting table 4. In this manner, when the medals M have dropped from the mounting surface 4*a* of the mounting table 4 to the drop port P, some medals M can enter the winning port 8.

The payout port 9 is provided so as to penetrate the lower portion of the partition portion 3 in the front-rear direction. In this manner, the medals M that have dropped to the bottom of the drop port P can be paid out from the payout port 9 to the operation space S1 side by driving a hopper mechanism (not illustrated).

Overview of Medal Arrangement Device

Figure 4:
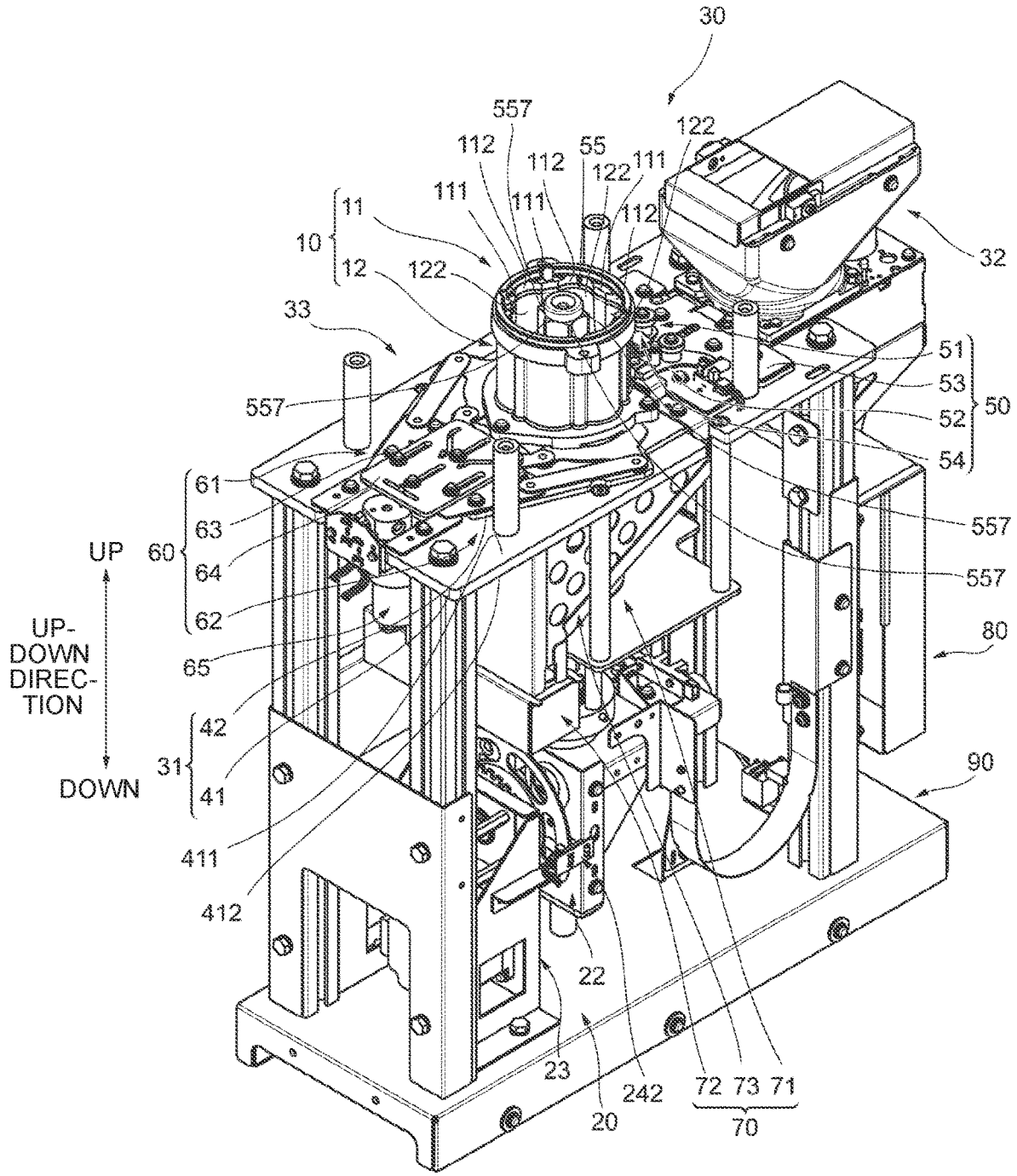
FIG. 4 is an overall perspective view of the medal arrangement device according to the present embodiment.
Figure 5:
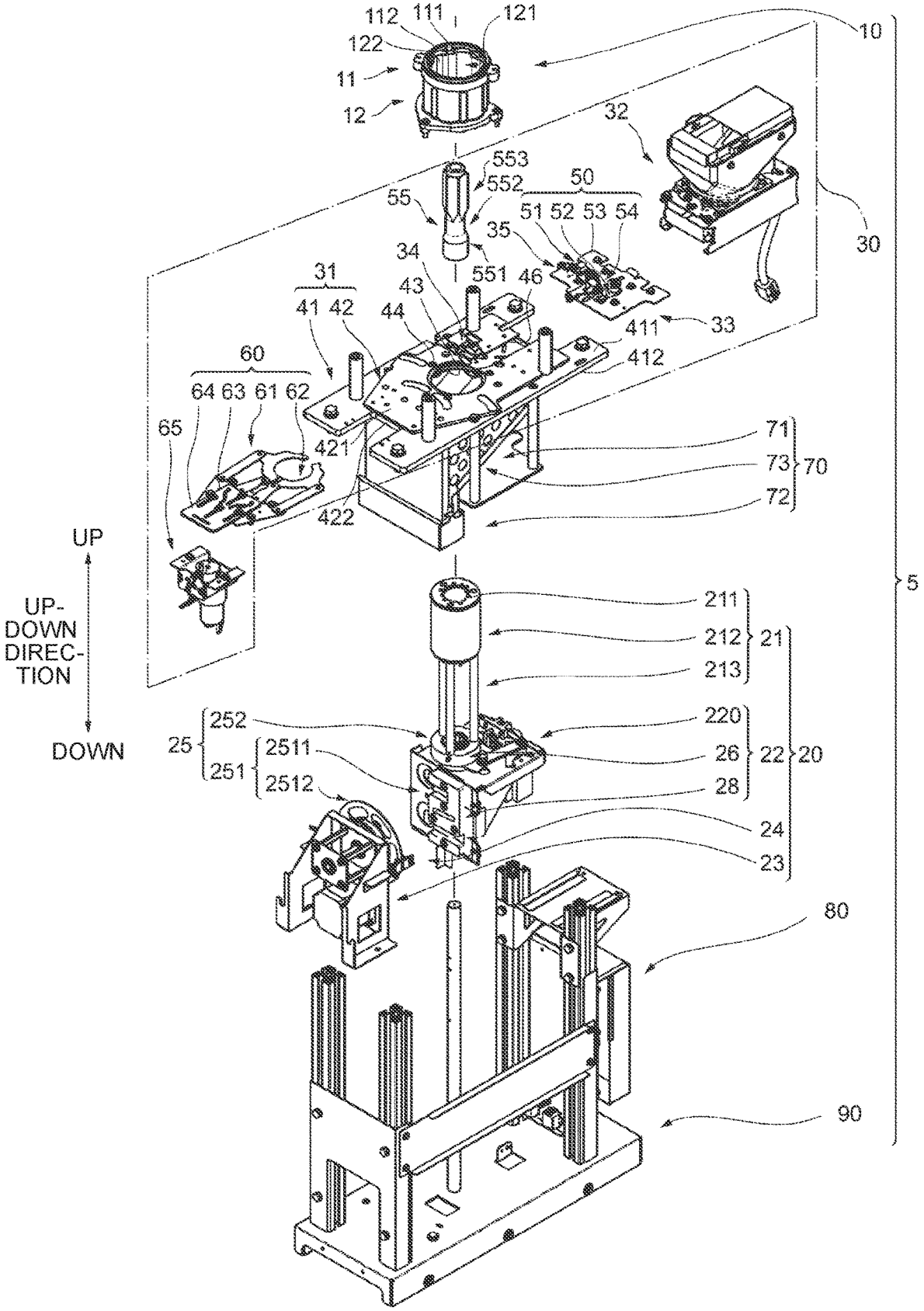
FIG. 5 is an exploded perspective view of the medal arrangement device according to the present embodiment.
Figure 6:
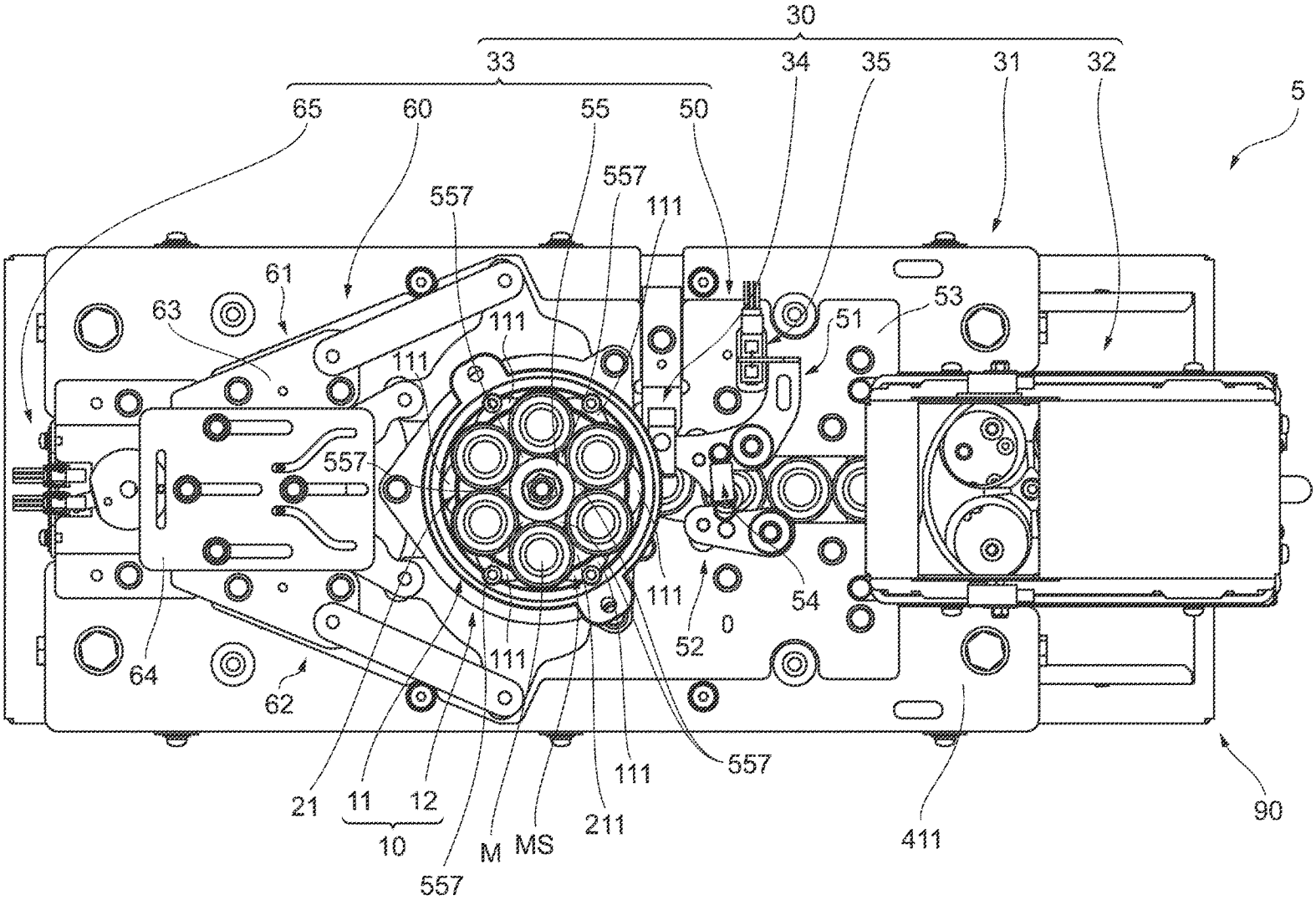
FIG. 6 is a plan view of the medal arrangement device according to the present embodiment.

Next, the overview of the medal arrangement device 5 according to the present embodiment will be described with reference to FIGS. 2, 4 to 6. FIGS. 4 to 6 are an overall perspective view, an exploded perspective view, and a plan view illustrating the configuration of the medal arrangement device 5. In the following description, the state of the medal arrangement device 5 illustrated in FIG. 4 may be referred to as an "assembled state", and the time when the medal arrangement device 5 operates may be referred to as a "time of stacking".

The medal arrangement device 5 according to the present embodiment is an example of a device for creating the medal tower used in the medal game machine 1 illustrated in FIG. 1. Here, the medal tower is formed by stacking plural layers of single-layer medal sets configured with a plurality of medals disposed in a predetermined arrangement. As illustrated in FIG. 2, a medal tower MT according to the present embodiment has a cylindrical shape formed by stacking plural layers of single-layer medal sets MS. Each single-layer medal set MS is configured by disposing six medals M in an annular shape on one circumference. The outer circumferential dimension of each single-layer medal set MS is greater than the outer diameter of the holder 21 for transporting each single-layer medal set MS, which will be described later (refer to FIG. 6). Further, in each medal M that configures any of the n-th single-layer medal sets MS (hereinafter, referred to as "n-th layer MS"), an arrangement direction on the circumference is deviated only by a predetermined centripetal angle (for example, 30°) with respect to each medal M that configures the (n+1)th layer MS and the (n−1)th layer MS.

The description returns to the overview of the medal arrangement device 5. As illustrated in FIGS. 4 and 5, the medal arrangement device 5 includes the mounter 10 on which the single-layer medal set MS and the medal tower MT are mounted; a transporter 20 that transports the single-layer medal set MS to the mounter 10; a supplier 30 that forms the single-layer medal set MS; a collector 70 that collects the medals M remaining in the device when a specific event occurs; a control unit 80 that controls the operation of the transporter 20, the supplier 30, and the collector 70; and a housing 90 that holds the above-described configuration of the medal arrangement device 5.

In the assembled state, as illustrated in FIGS. 4 and 5, a part of the transporter 20, the supplier 30, and the control unit 80 are directly attached to the housing 90. The mounter 10 is fixed above the supplier 30, and the collector 70 is fixed below the supplier 30. Further, the mounter 10, the supplier 30, and the collector 70 are formed with a penetrating space that penetrates the center parts of the three elements in an up-down direction. The penetrating space configures a transport passage 200 (refer to FIG. 16A) for transporting the single-layer medal set MS to the mounter 10. The holder 21, which will be described later, of the transporter 20 is provided so as to be capable of moving up and down and rotate in the transport passage 200.

Here, the transport passage 200 is formed in a range from the first position P1 in which the holder 21 stands by at the lowermost side inside the collector 70 to a third position P3 for adjusting the mounted state of the single-layer medal set MS above the mounter 10, in the up-down direction. Further, the transport passage 200 passes through a position for the supplier 30 to supply the medal M, that is, a second position P2 when a holding surface 211, which will be described later, of the holder 21, configures the bottom portion of the second medal passage part 402. The holding surface 211 of the holder 21 is provided so as to be able to stop at each of the first position P1, the second position P2, and the third position P3.

In this manner, at the time of stacking, when the holding surface 211 of the transporter 20 moves to the second position P2 based on the control of the control unit 80, the supplier 30 supplies six medals M to the holding surface 211 and configures the first layer MS. Subsequently, the holding surface 211 is raised to the third position P3 while holding the first layer MS, and is lowered after rotating such that the position of the first layer MS corresponds to the positions of the mounting surface 111 of the mounter 10 and a mounting surface 557 (refer to FIGS. 4 and 6) of a second guider 55, which will be described later. In this lowering process, the first layer MS held on the holding surface 211 is disposed on the mounting surface 111 and the mounting surface 557 and mounted on the mounter 10. After this, when the holding surface 211 returns to the second position P2 and the above-described operation is repeated, the holding surface 211 can be mounted by transporting the n-th layer MS from the second layer MS to the mounter 10. In this manner, the medal arrangement device 5 configures the medal tower MT. In addition, the details of the configuration of the medal tower MT by the medal arrangement device 5 will be described in accordance with the control by the control unit 80, which will be described later.

Details of Medal Arrangement Device

Subsequently, the important configuration of the medal arrangement device 5 will be described in detail with reference to FIGS. 4 to 25. Hereinafter, the mounter 10, the supplier 30, the transporter 20, the collector 70, and the control unit 80 will be described in this order.

Mounter

First, the details of the mounter 10 will be described with reference to FIGS. 2 and 4 to 6. As illustrated in FIGS. 4 and 6, the mounter 10 includes a mounting surface portion 11 on which the single-layer medal set MS and the medal tower MT are mounted; and a support unit 12 that supports the mounting surface portion 11.

The mounting surface portion 11 has a ring shape. As illustrated in FIGS. 4 to 6, the mounting surface portion 11 includes six mounting surfaces 111 for mounting a part of the main surface of each medal M of the single-layer medal set MS; and six transport surfaces 112 provided between the adjacent mounting surfaces 111.

The support unit 12 has a cylindrical shape. As illustrated in FIGS. 4 to 6, the inner circumferential surface 121 of the support unit 12 has six transport surfaces 122 formed so as to correspond to the six transport surfaces 112 of the mounting surface portion 11. The transport surface 122 is formed such that the cross-sectional area becomes narrower as going upward. Accordingly, the medals M disposed on the holding surface 211 can be brought closer to the center side of the support unit 12 and aligned as being transported upward.

Supplier

Figure 7:
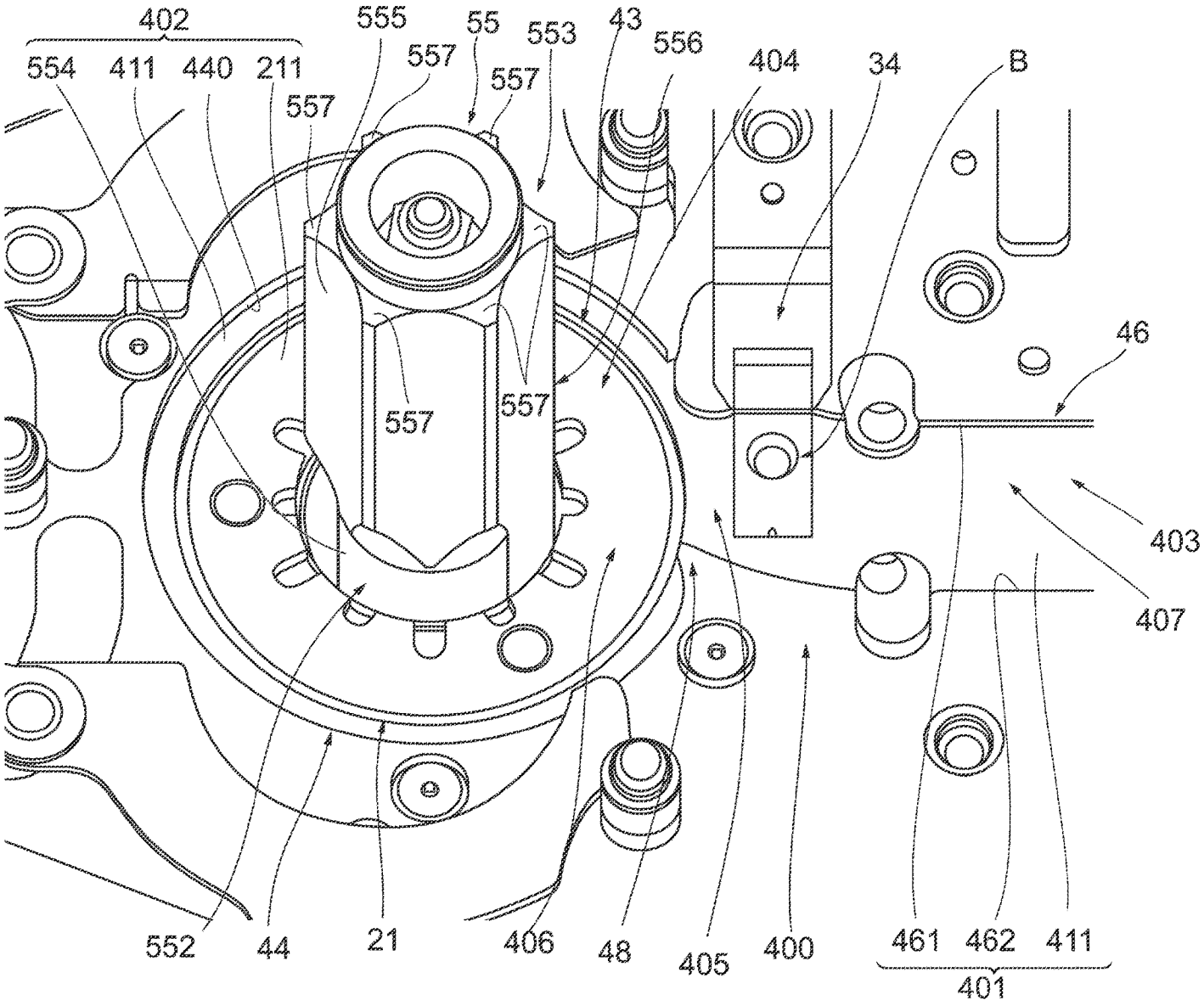
FIG. 7 is a perspective view illustrating a partial configuration of a supplier of the medal arrangement device according to the present embodiment.
Figure 8:
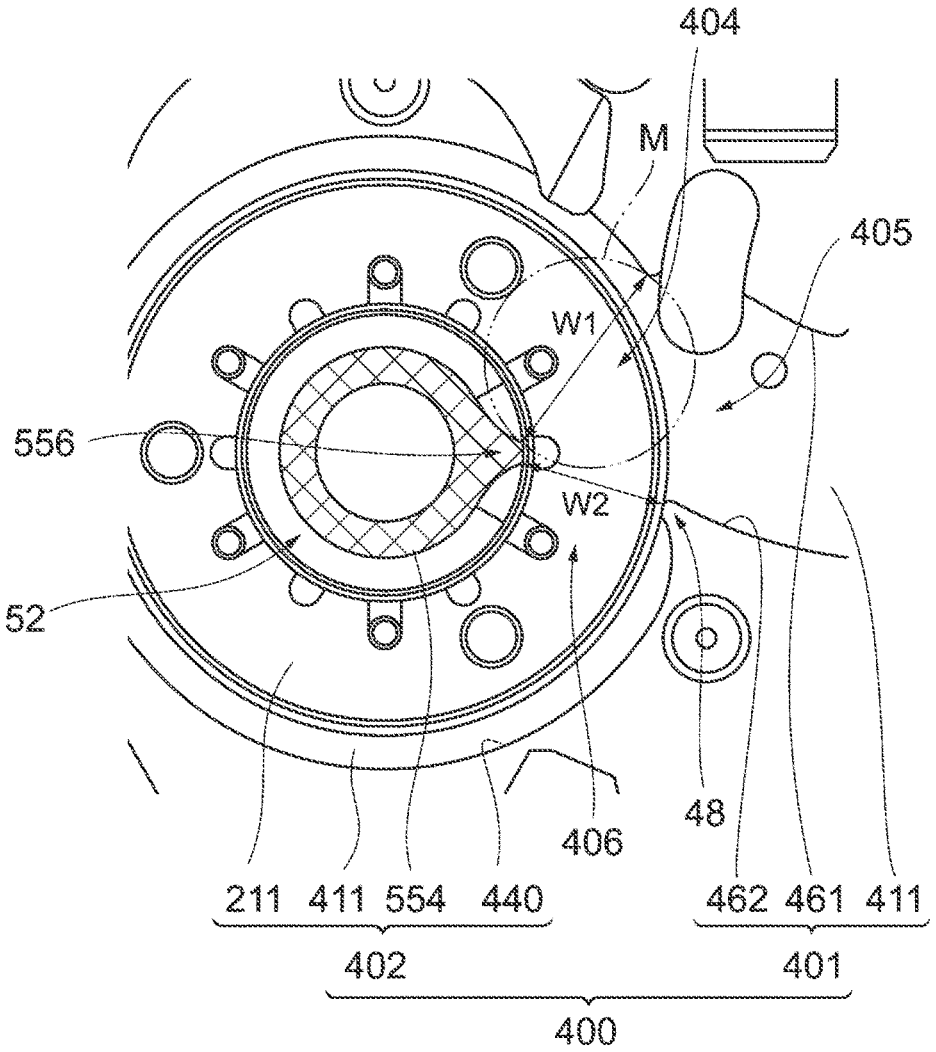
FIG. 8 is a plan view illustrating a partial configuration of the supplier of the medal arrangement device according to the present embodiment.
Figure 9:
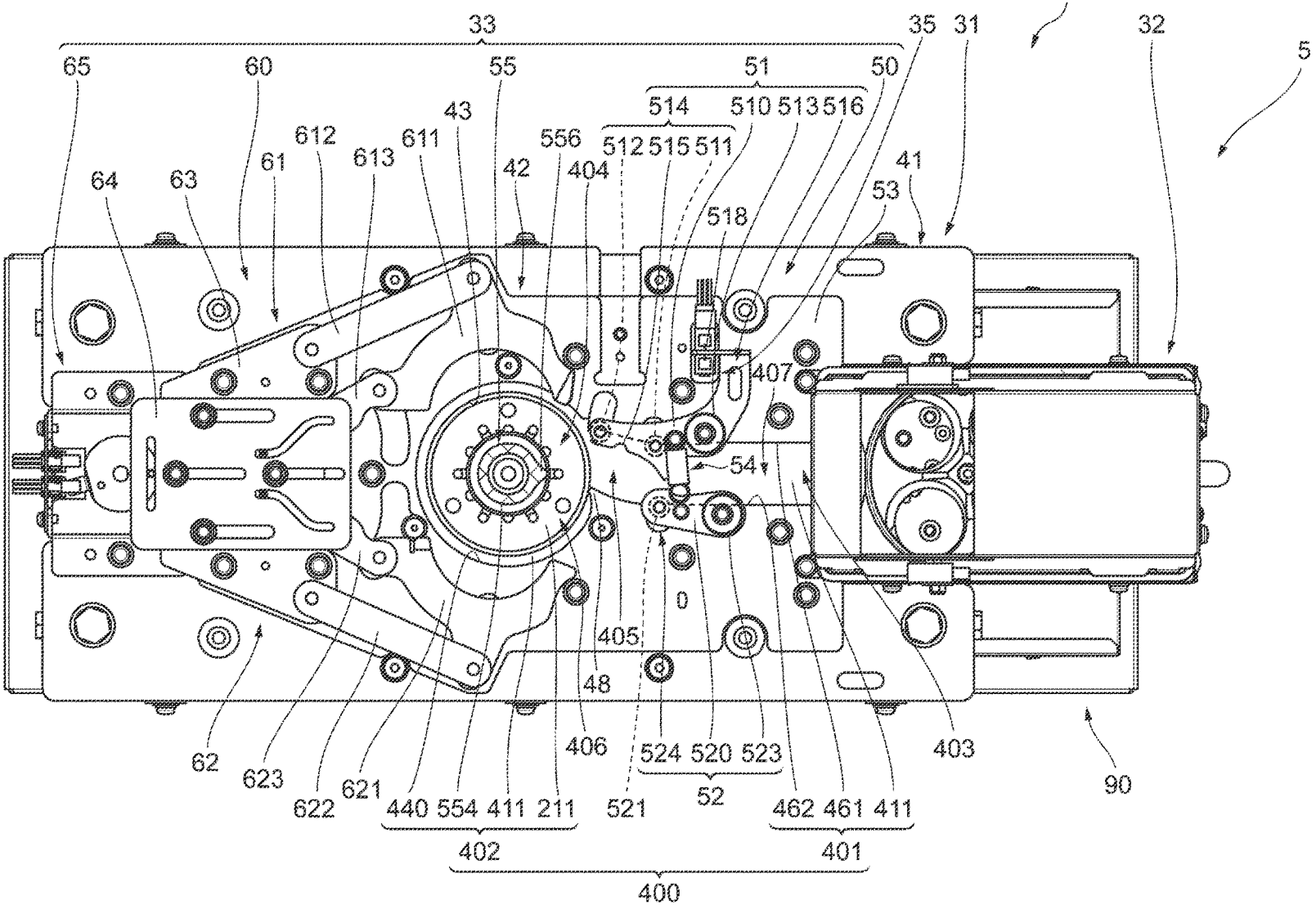
FIG. 9 is a view illustrating a configuration and a first state of the supply of the medal arrangement device according to the present embodiment.
Figure 10:
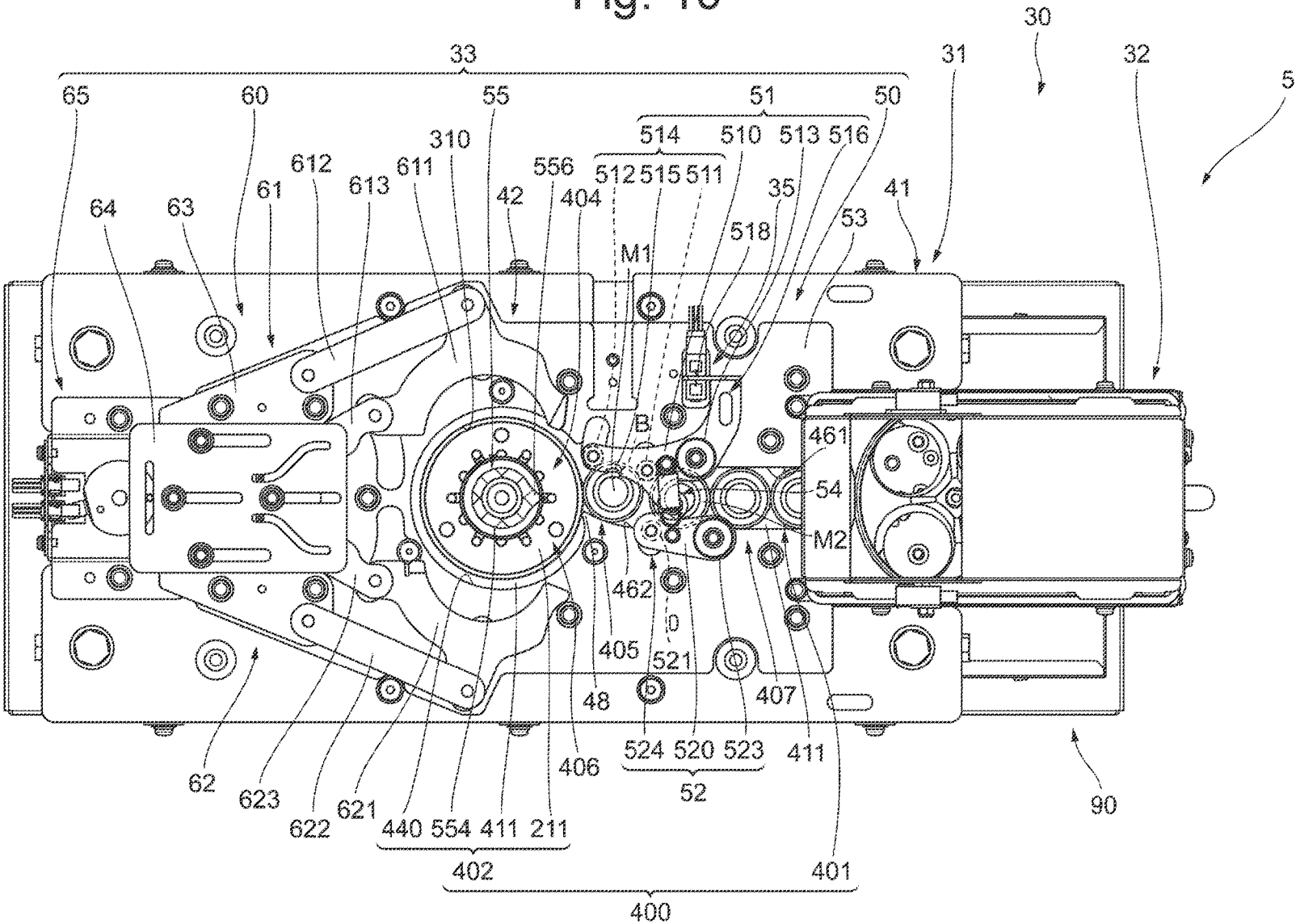
FIG. 10 is a view illustrating a fourth state of a first guider of the medal arrangement device according to the present embodiment.
Figure 11:
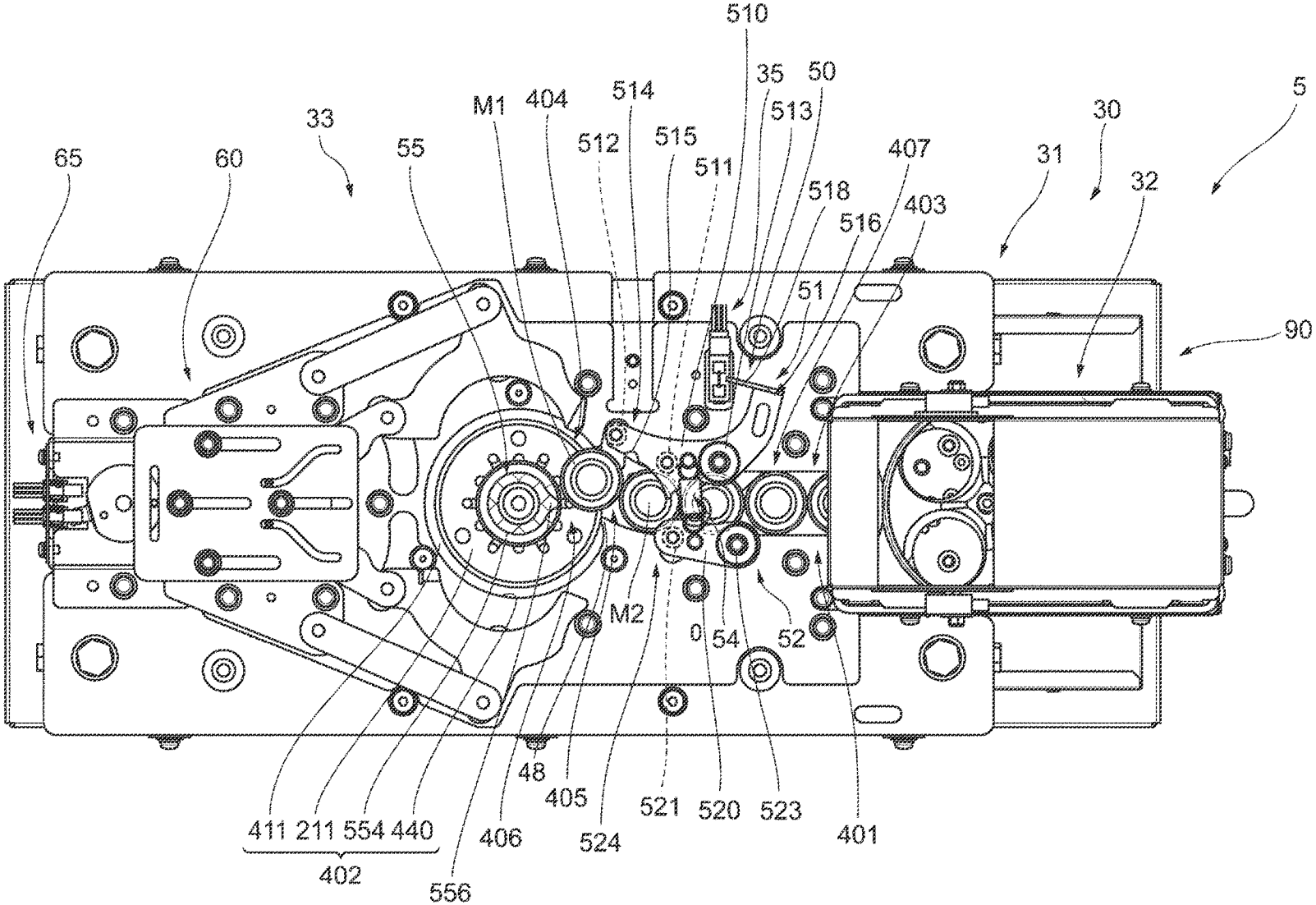
FIG. 11 is a view illustrating a fifth state of the first guider of the medal arrangement device according to the present embodiment.
Figure 12:
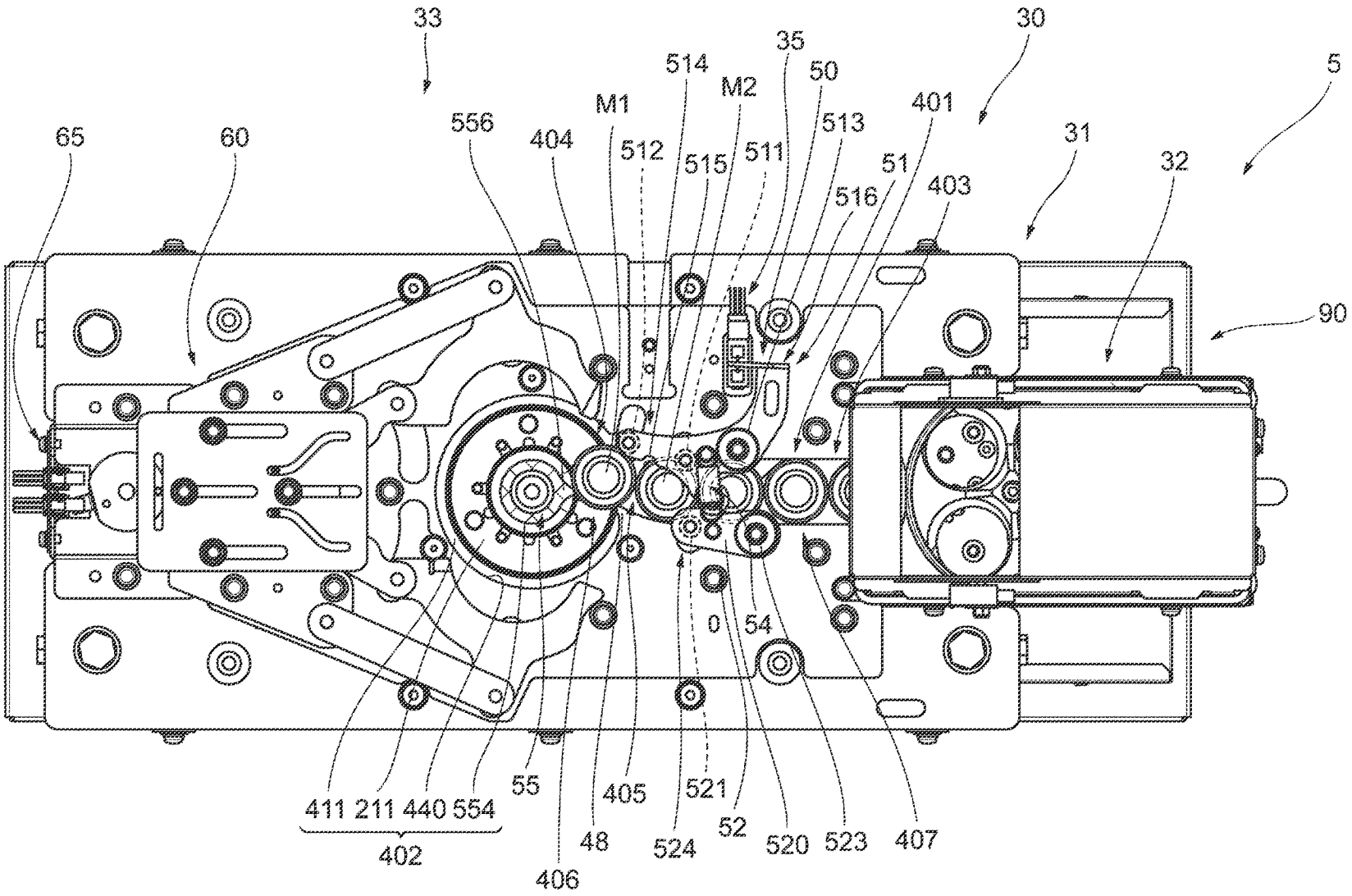
FIG. 12 is a view illustrating a state where medals enter the upstream end portion of a second medal passage part in the medal arrangement device according to the present embodiment.

Next, the details of the supplier 30 will be described with reference to FIGS. 4 to 12. Hereinafter, the operation of the supplier 30 will be described after describing the details of each configuration of the supplier 30. FIGS. 7 and 8 are a perspective view and a plan view illustrating a partial configuration of the supplier 30. FIG. 9 is a view illustrating the configuration and a first state of the supplier 30. FIGS. 10 and 11 are views illustrating fourth and fifth states of the first guider. FIG. 12 is a view illustrating a state where the medal M enters an upstream end portion 404 of the second medal passage part 402.

As illustrated in FIGS. 5 and 9, the supplier 30 includes an attaching unit 31 that configures medal passage 400 which will be described later; a medal hopper 32 for ejecting the medals M into the medal passage 400 one by one; a guide unit 33 for guiding the ejected medal M; a medal sensor 34 for acquiring information on the presence or absence of the medal M at a predetermined position B of the medal passage 400; and a lever sensor 35 for acquiring information on the number of medals M flowing into the second medal passage part 402.

Attaching Unit

As illustrated in FIG. 5, the attaching unit 31 has a plate shape. In the assembled state, the attaching unit 31 is attached to the housing 90. Further, the attaching unit 31 includes a first attaching plate 41 and a second attaching plate 42 provided on the first attaching plate 41.

As illustrated in FIG. 5, the first attaching plate 41 has a first main surface 411 and a second main surface 412 on both sides in the thickness direction. Further, the first attaching plate 41 includes a hole portion 43 penetrating the center part of the first attaching plate 41 in the thickness direction, and a plurality of other holes and grooves for attachment. The plan view shape of the hole portion 43 is circular. The diameter of the hole portion 43 is greater than that of the appearance of the holder 21.

As illustrated in FIG. 5, the second attaching plate 42 has a first main surface 421 and a second main surface 422 on both sides in the thickness direction. Further, the second attaching plate 42 includes a hole portion 44 penetrating the second attaching plate 42 in the thickness direction; a notch portion 46; and a plurality of other holes and grooves for attachment. The hole portion 44 is provided at a position where the hole portion 44 can be disposed concentrically with the hole portion 43 of the first attaching plate 41 in the assembled state, and the notch portion 46 is provided so as to be linked to the hole portion 44.

Further, as illustrated in FIG. 7, the hole portion 44 has a side wall portion 440 provided so as to be orthogonal to the first main surface 421. The plan view shape of the hole portion 44 is circular. The diameter of the hole portion 44 is greater than the diameter of the hole portion 43 of the first attaching plate 41. The notch portion 46 has a first side wall surface 461 and a second side wall surface 462 facing each other. The width of the notch portion 46, that is, the distance between the first side wall surface 461 and the second side wall surface 462, is greater than the diameter of one medal M. Further, a protrusion 48 that is projected toward the center of the hole portion 44 is provided at a linking position between the side wall portion 440 of the hole portion 44 and the second side wall surface 462 of the notch portion 46.

In this manner, the medal passage 400 is configured by attaching the second attaching plate 42 to the first main surface 411 of the first attaching plate 41. Specifically, the first main surface 411, the first side wall surface 461, and the second side wall surface 462 configure a first medal passage part 401 on the upstream side of the medal passage 400. The first main surface 411, the holding surface 211 positioned at the second position P2, the side wall portion 440, and the side surface 554 of the second guider 55 (refer to FIGS. 7 and 8) which will be described later configure the second medal passage part 402 on the downstream side of the medal passage 400.

Here, as illustrated in FIG. 7, the height of the holding surface 211 positioned at the second position P2 is preferably formed to be slightly lower than the height of the first main surface 411 (for example, 0.4 mm lower). According to this, the medals M can move more smoothly in the second medal passage part 402. Hereinafter, the holding surface 211 that configures the bottom portion of the second medal passage part 402 at the second position P2 may be referred to as "holding surface 211 of the second medal passage part 402".

The first medal passage part 401 is a substantially linear passage part. The width of the first medal passage part 401 is greater than the diameter of one medal M. Further, the first medal passage part 401 has an upstream end portion 403 and a downstream end portion 405. An upstream region 407 where the upstream end portion 403 is present has a linear shape, and the downstream end portion 405 is curved so as to link the upstream region 407 and the upstream end portion 404 of the second medal passage part 402 which will be described later. In this manner, the moving medals M in the first medal passage part 401 can smoothly flow into the second medal passage part 402 by the guidance of the downstream end portion 405.

The second medal passage part 402 is an annular passage part formed on the holding surface 211 positioned at the second position P2 along the circumferential direction of the holding surface 211, and is linked to the downstream end portion 405 of the first medal passage part 401. The circumferential length of the second medal passage part 402 is formed such that six medals M can be disposed. The width of the second medal passage part 402 is greater than the diameter of one medal M. Further, the second medal passage part 402 has the upstream end portion 404 and a downstream end portion 406.

The protrusion 48 extending inward of the second medal passage part 402 is formed on the tip end side of the downstream end portion 406. Therefore, the width of the part of the second medal passage part 402 at which the protrusion 48 is present is less than the diameter of one medal M. In this manner, the medal M moving in the second medal passage part 402 is stopped by the protrusion 48, and accordingly, the second medal passage part 402 is filled with the six medals M, and the six medals M are disposed on the holding surface 211 of the second medal passage part 402.

Medal Hopper

The medal hopper 32 is attached to the housing 90 such that the ejection port (not illustrated) of the medal M is connected to the upstream end portion 403 of the first medal passage part 401 in the assembled state. Further, the height of the lower surface of the ejection port of the medal hopper 32 is substantially the same as that of the first main surface 411, which is the bottom portion of the first medal passage part 401. Therefore, at the time of stacking, the medals M can be quickly and stably ejected from the medal hopper 32 into the first medal passage part 401 in a horizontal state. As the medal hopper 32, for example, a coin hopper manufactured by Asahi Seiko Co., Ltd., of which the model number is FV-525 can be adopted. In addition, another product may be adopted as the medal hopper 32.

Guide Unit

The guide unit 33 has three guiders that guide the moving state when the medal M moves in the medal passage 400. Specifically, as illustrated in FIGS. 5 and 9, the guide unit 33 includes a first guider 50 that adjusts the moving speed or the like of the medals M in the first medal passage part 401; a second guider 55 that defines the traveling direction of the medals M in the second medal passage part 402; and a third guider 60 that restricts the movement of the medals M in the thickness direction in the second medal passage part 402. Further, the guide unit 33 has a guide actuator 65 that drives the operation of the third guider 60.

The first guider 50 is provided on the first medal passage part 401 side. As illustrated in FIGS. 5 and 9, the first guider 50 includes a first abutting part 51 provided on the first side wall surface 461 side of the first medal passage part 401; a second abutting part 52 provided on the second side wall surface 462 side of the first medal passage part 401; a link 54 that links the first abutting part 51 and the second abutting part 52 to each other so as to urge each other; and an attaching plate 53 for attaching the first abutting part 51, the second abutting part 52, and the link 54. The first abutting part 51 and the second abutting part 52 are movable. The link 54 has a spring structure.

The first abutting part 51 has a lever structure. As illustrated in FIG. 9, the first abutting part 51 includes a lever main body 510 and a fulcrum 513 that rotatably supports the lever main body 510. The fulcrum 513 is fixed to the first side wall surface 461 side of the first medal passage part 401. The part positioned on the downstream side of the fulcrum 513 of the lever main body 510 configures a downstream free end 514 of the lever main body 510, and the part positioned on the upstream side of the fulcrum 513 of the lever main body 510 configures an upstream free end 516 of the lever main body 510. The downstream free end 514 and the upstream free end 516 are provided so as to rotate around the fulcrum 513 by contact between the downstream free end 514 and the medal M.

As illustrated in FIG. 9, the downstream free end 514 has an escaping unit 515 for avoiding interference between the lever main body 510 and the optical axis of the medal sensor 34. Further, the downstream free end 514 is provided with an upstream abutting part 511 and a downstream abutting part 512. The upstream abutting part 511 and the downstream abutting part 512 are configured with rollers having the same size. In addition, the upstream abutting part 511 and the downstream abutting part 512 may be a projection that corresponds to a part of the lever main body 510, a plate supported by a spring, a recess portion formed in the lever main body 510, or the like. As illustrated in FIG. 10, the shortest distance between the upstream abutting part 511 and the downstream abutting part 512 is less than the diameter of one medal M.

Further, the upstream abutting part 511 and the downstream abutting part 512 are provided such that the positions with respect to the first medal passage part 401 change depending on the contact with the medal M. When the medal M does not reach the upstream abutting part 511, the link 54 is provided to urge the upstream abutting part 511 and the downstream abutting part 512 toward the second side wall surface 462, as illustrated in FIG. 9. In this case, at least a part of each of the upstream abutting part 511 and the downstream abutting part 512 is positioned in the first medal passage part 401.

Meanwhile, when the medal M contacts the upstream abutting part 511 due to the movement of the medal M, the upstream abutting part 511 presses the medal M to move in the width direction of the first medal passage part 401, as illustrated in FIGS. 10 to 12. At this time, the downstream abutting part 512 rotates around the fulcrum 513 in a direction away from the first medal passage part 401 or a direction approaching the first medal passage part 401 as the position at which the upstream abutting part 511 contacts the side surface of the medal M changes.

More specifically, as illustrated in FIG. 10, the upstream abutting part 511 and the downstream abutting part 512 are provided such that, when one medal M reaches the predetermined position B (refer to FIGS. 7 and 10) of the downstream end portion 405, at least a part of each of the upstream abutting part 511 and the downstream abutting part 512 is positioned in the first medal passage part 401 so as to press the medal M against the second side wall surface 462. In this manner, the medal M can be restrained in a short time by the upstream abutting part 511, the downstream abutting part 512, and the second side wall surface 462, and the movement can be slightly suppressed. Accordingly, the medal sensor 34 can accurately detect the presence or absence of the medal M at the predetermined position B. Here, the predetermined position B (that is, the position immediately before entering the second medal passage part 402) is a position where the optical axis at the time of measurement of the medal sensor 34 (refer to FIGS. 6 and 7) radiates.

Further, regarding the upstream abutting part 511 and the downstream abutting part 512, when the above-described medal M passes through the predetermined position B, as illustrated in FIGS. 11 and 12, the downstream abutting part 512 is provided so as to retract to the outside of the first medal passage part 401. In this manner, the load on the medal M by the downstream abutting part 512 can be released to allow the medal to move. As a result, the supplying speed of the medal M can be maintained.

The upstream free end 516 has a rod-shaped protrusion 518 formed at the end portion, as illustrated in FIGS. 9 and 11. The protrusion 518 is provided such that the position with respect to the lever sensor 35 changes depending on the contact between the upstream abutting part 511 and the medal M. When the medal M does not reach the upstream abutting part 511, the protrusion 518 is positioned directly above the lever sensor 35 by the link 54, as illustrated in FIG. 9. In this case, the lever sensor 35 can detect the protrusion 518. In the following, the position of the protrusion 518 in a case where the lever sensor 35 can detect the protrusion 518 is referred to as "detectable position", and there is a case where the position of the protrusion 518 in a case where the lever sensor 35 cannot detect the protrusion 518 is referred to as "undetectable position".

Meanwhile, when the medal M contacts the upstream abutting part 511 due to the movement of the medal M, the protrusion 518 rotates around the fulcrum 513 in a direction of being separated from or approaching the lever sensor 35 as the position at which the upstream abutting part 511 contacts the side surface of the medal M changes, as illustrated in FIGS. 10 to 12. As a result, the protrusion 518 can move between the detectable position and the undetectable position of the lever sensor 35.

More specifically, when the side surface part that corresponds to the diameter of one medal M contacts the upstream abutting part 511 in the width direction of the first medal passage part 401, the protrusion 518 is at the undetectable position of the lever sensor 35 as illustrated in FIG. 11. On the other hand, when the other side surface part that corresponds to the non-diameter of one medal M contacts the upstream abutting part 511 in the width direction of the first medal passage part 401, the protrusion 518 is at the detectable position of the lever sensor 35 as illustrated in FIGS. 10 and 12.

In this manner, from the time when one medal M starts to abut against the upstream abutting part 511 to the time when the abutment against the upstream abutting part 511 is released (that is, when passing through the predetermined position B), the position of the protrusion 518 with respect to the lever sensor 35 changes from the detectable position to the undetectable position, and then returns to the detectable position again. In this manner, the lever sensor 35 can detect that one medal M has passed through the predetermined position B by detecting the position change of the protrusion 518 described above. Further, by calculating the number of changes in the position of the protrusion 518, the lever sensor 35 can accurately detect the number of medals M that flow into the second medal passage part 402 at the downstream end portion 405 of the first medal passage part 401.

The second abutting part 52 is adopted as a sub-abutting part of the first abutting part 51. Further, the second abutting part 52 has a lever structure and is formed to be smaller than the first abutting part 51. As illustrated in FIG. 9, the second abutting part 52 includes a lever main body 520 and a fulcrum 523 that rotatably supports the lever main body 520. The fulcrum 523 is fixed to the second side wall surface 462 side of the first medal passage part 401.

A part of the lever main body 520 positioned on the downstream end portion 405 side configures a free end 524 of the lever main body 520. The free end 524 is provided with an abutting part 521. The abutting part 521 is configured with the same rollers as those of the upstream abutting part 511. In the width direction of the first medal passage part 401, the abutting part 521 is provided so as to face the upstream abutting part 511. In other words, the abutting part 521 is provided so as to be in contact with the medal M at the same time as the upstream abutting part 511.

When the medal M does not come into contact with the abutting part 521, the abutting part 521 is provided so as to be urged toward the first side wall surface 461 by the link 54. In this case, a part of the abutting part 521 is positioned in the first medal passage part 401. Meanwhile, when the medal M comes into contact with the abutting part 521, the abutting part 521 rotates around the fulcrum 523 in the direction of being separated from or approaching the first medal passage part 401 as the position at which the abutting part 521 contacts the side surface of the medal M changes.

The second guider 55 has a rod shape. In the assembled state, the second guider 55 is fixed to the central axis of the housing 90 so as to pass through the center of the holder 21 (refer to FIG. 13). As illustrated in FIGS. 5, 7, and 8, the second guider 55 includes a first portion 551 for attaching the second guider 55 to the central axis of the housing 90; a second portion 552 that configures a side wall surface of the second medal passage part 402; and a third portion 553 that holds the posture of the medals M while being transported, in the axial direction. In the assembled state, the second portion 552 is disposed on the second medal passage part 402 side, and the third portion 553 is disposed on the mounter 10 side.

As illustrated in FIG. 7, the second portion 552 is provided at the center of the holding surface 211 of the second medal passage part 402 so as to be perpendicular to the holding surface 211. Further, the second portion 552 has a cylindrical side surface 554 and a protrusion 556 formed on the side surface 554. The side surface 554, together with the side wall portion 440, configures the side wall portion of the second medal passage part 402. As illustrated in FIG. 8, the protrusion 556 is provided so as to face the downstream end portion 405 of the first medal passage part 401.

Further, as illustrated in FIG. 8, the distance between the tip end of the protrusion 556 and the most downstream end of the first side wall surface 461, that is, a width dimension W1 of the upstream end portion 404 of the second medal passage part 402 is equal to or greater than the diameter of one medal M. In order to allow the medals M to smoothly flow into the second medal passage part 402 and to maintain an effect of guiding the medals M in the moving direction by both side walls of the second medal passage part 402, the width dimension W1 of the upstream end portion 404 is preferably formed to be slightly greater than the diameter of one medal M. Meanwhile, the distance between the protrusion 556 and the most downstream end of the second side wall surface 462, that is, a width dimension W2 of the downstream end portion 406 of the second medal passage part 402 is less than the diameter of one medal M. In this manner, when the medal M flows from the first medal passage part 401 into the second medal passage part 402, the protrusion 556 can guide the medal M to flow in from the upstream end portion 404 of the second medal passage part 402.

As illustrated in FIGS. 5 and 7, the third portion 553 forms a substantially hexagonal prism. Specifically, as illustrated in FIG. 7, the third portion 553 has six side surfaces 555 of the substantially hexagonal prism; and six mounting surfaces 557 that configure the upper end surface of the substantially hexagonal prism.

Each side surface 555 is a curved surface formed so as to match the shape of the medal M. In the assembled state, the side surface 555 is provided concentrically with the inner circumferential surface 121 of the support unit 12 of the mounter 10. Accordingly, when the holding surface 211 is raised from the second position P2 toward the third position P3 while holding the single-layer medal set MS, each side surface 555 of the third portion 553 and each transport surface 122 of the inner circumferential surface 121 can guide each medal M of the single-layer medal set MS from both sides in the radial direction. In this manner, in the transport passage 200, the posture deviation of each medal M of the single-layer medal set MS while being transported can be suppressed.

As illustrated in FIG. 4, each mounting surface 557 is provided so as to have the same height as that of each mounting surface 111 of the mounter 10. Further, as illustrated in FIG. 6, each mounting surface 557 is provided at a position that corresponds to each mounting surface 111. In this manner, each medal M of the single-layer medal set MS can be supported from both sides in the radial direction of the medal main surface by one mounting surface 557 and one mounting surface 111 provided at corresponding positions. As a result, the single-layer medal set MS can be mounted on the mounting surface 557 and the mounting surface 111 in a stable state.

The third guider 60 has a link structure. As illustrated in FIGS. 5 and 9, the third guider 60 includes a first link portion 61; a second link portion 62; an attaching plate 63 and an attaching plate 64 for attaching the first link portion 61 and the second link portion 62. The first link portion 61 and the second link portion 62 are attached to the attaching unit 31 by the attaching plate 63. Further, the first link portion 61 and the second link portion 62 have a symmetrical configuration. Hereinafter, the configuration of the first link portion 61 will be mainly described, and the description of the second link portion 62 will be simplified.

As illustrated in FIG. 9, the first link portion 61 includes a first link 611; a second link 612 that links the first link 611 to the attaching plate 63; and a third link 613 that links the first link 611 to the attaching plate 64. The first link 611 is an example of a guide plate and has a C shape. Specifically, the first link 611 is formed so as to cover the upstream half of the second medal passage part 402 from above the second medal passage part 402.

In addition, in a case where the first link 611 covers the second medal passage part 402, the distance between the surface of the first link 611 facing the holding surface 211 of the second medal passage part 402 and the holding surface 211 of the second medal passage part 402 is greater than the thickness of one medal M and less than the thickness of two medals M. In this manner, the movement of the medal M in the thickness direction during the movement of the medal M that moves to the upstream half of the second medal passage part 402 and the number of medals M that can pass through the second medal passage part 402 can be restricted at the same time.

As illustrated in FIG. 9, the second link portion 62 has the same configuration as that of the first link portion 61. The disposing direction of the second link 621 is opposite to that of the first link 611. In other words, the second link 621 is formed so as to cover the downstream half of the second medal passage part 402 from above the second medal passage part 402.

In a case where the second link 621 covers the second medal passage part 402, the distance between the surface of the second link 621 facing the holding surface 211 of the second medal passage part 402 and the holding surface 211 of the second medal passage part 402 is greater than the thickness of one medal M and less than the thickness of two medals M. In this manner, the movement of the medal M in the thickness direction during the movement of the medal M that moves to the downstream half of the second medal passage part 402 and the number of medals M that can pass through the second medal passage part 402 can be restricted at the same time.

The guide actuator 65 is configured to drive the movement of the third guider 60. As illustrated in FIG. 4, the guide actuator 65 is attached to the second main surface 412 side of the attaching unit 31. Further, the guide actuator 65 is connected to the control unit 80. At the time of stacking, the guide actuator 65 moves the first link 611 and the second link 612 to a position where the second medal passage part 402 is covered. In this manner, the movement of the medal M moving in the second medal passage part 402 in the thickness direction can be restricted. Meanwhile, after the single-layer medal set MS is formed, the guide actuator 65 moves the first link 611 and the second link 612 to a position where the second medal passage part is not covered. In this manner, the holder 21 positioned at the second position is raised to the third position, and the single-layer medal set MS can be transported to the mounter 10.

Medal Sensor

The medal sensor 34 is a sensor for detecting the presence or absence of the medal M at the predetermined position B (refer to FIGS. 7 and 10) of the first medal passage part 401. As illustrated in FIGS. 5 and 7, the medal sensor 34 is fixed to the attaching unit 31 so as to face the predetermined position B of the first medal passage part 401. In this manner, the medal sensor 34 can detect the presence or absence of the medal M at the position immediately before the medal M flows into the second medal passage part 402.

Further, the medal sensor 34 transmits the acquired information on the presence or absence of the medal M at the predetermined position B to the control unit 80. Then, the control unit 80 can start the supplier of the medal M by the medal hopper 32 or can activate the guide actuator 65 based on the information on the presence or absence of the medal M to move the first link 611 and the second link 612 to the position where the second medal passage part 402 is not covered or the position where the second medal passage part 402 is covered, and it is possible to detect the presence or absence of a failure of the medal hopper 32 and the guide actuator 65. In this manner, the medal M can be supplied in a stable state and flow into the second medal passage part 402 based on the information on the presence and absence of the medal M acquired by the medal sensor 34.

Lever Sensor

The lever sensor 35 is a sensor for acquiring information on the number of medals M to flow into the second medal passage part 402. As illustrated in FIG. 9, the lever sensor 35 is fixed to the attaching unit 31 so as to be positioned on the upstream free end 516 side of the first abutting part 51. The lever sensor 35 can detect whether the protrusion 518 of the upstream free end 516 is at the detectable position or the undetectable position, and can measure the number of changes at the detectable position of the protrusion 518. As a result, based on the number of changes in the position of the protrusion 518, the lever sensor 35 can accurately detect the number of medals M that flow into the second medal passage part 402 at the downstream end portion 405 of the first medal passage part 401.

Here, in the process in which one medal M passes through the upstream abutting part 511 (or the predetermined position B), after changing the position of the protrusion 518 from the detectable position to the undetectable position, the lever sensor 35 can detect the change so as to return to the detectable position again. In other words, the lever sensor 35 can detect that the number of medals M that have passed through the predetermined position B is one, by detecting such a position change of the protrusion 518. Further, when the lever sensor 35 measures the number of such changes in the position of the protrusion 518, it is possible to accurately detect the number of medals M that have passed through the predetermined position B and flow into the second medal passage part 402.

Further, the lever sensor 35 transmits the acquired information on the number of medals M to the control unit 80. Then, the control unit 80 can start, continue, stop, or restart the supplier of medals M by the medal hopper 32 based on the information on the number of medals M. Further, the control unit 80 can control the operation of the guide actuator 65 based on the information on the number of medals M. In this manner, only the preset number of medals M can flow into the second medal passage part 402 based on the information on the number of medals M acquired by the lever sensor 35. Accordingly, the defect of the medal tower MT due to an insufficient number of medals M flowing into the second medal passage part 402, and the clogging of the medal passage 400 and the failure of the medal hopper 32 due to an excessive number of medals M flowing into the second medal passage part 402 can be suppressed.

Operation of Supply

Next, the operation of the supplier 30 will be described with reference to FIGS. 9 to 11. In the following, for convenience of description, the side surface part that corresponds to the diameter of the medal M passing through the first medal passage part 401 in the width direction of the first medal passage part 401 is referred to as "diameter portion of the medal M", the half of the side surface on the downstream side of the diameter portion of the medal M is referred to as "first portion of the medal M", and the half of the side surface on the upstream side of the diameter portion of the medal M is referred to as "second portion of the medal M". Further, there is a case where the n-th medal M is referred to as "medal Mn" based on the order of ejection from the medal hopper 32. In FIGS. 9 to 11, in order to make it easier to see the state of the second medal passage part 402, the third guider 60 is displayed so as not to cover the second medal passage part 402, but in reality, the third guider 60 is formed so as to cover the second medal passage part 402.

Based on the control of the control unit 80, the supplier 30 starts to operate. First, by driving the guide actuator 65, the first link 611 and the second link 612 of the third guider 60 are transferred to a position where the covers the second medal passage part. Next, the medals M are ejected one by one to the upstream end portion 403 of the first medal passage part 401 by driving a motor (not illustrated) of the medal hopper 32. In the first state where a medal M1 does not reach the upstream abutting part 511 and the abutting part 521, as illustrated in FIG. 9, the upstream abutting part 511 and the downstream abutting part 512 are provided to be urged toward the second side wall surface 462 by the urging of the link 54, and the abutting part 521 is provided so as to be urged toward the first side wall surface 461. In this case, at least a part of each of the upstream abutting part 511, the downstream abutting part 512, and the abutting part 521 is positioned in the first medal passage part 401. Further, in the first state, the medal sensor 34 does not detect the medal M1. The lever sensor 35 detects the protrusion 518 at the detectable position.

Meanwhile, in the abutting state where the medal M1 contacts the upstream abutting part 511 and the abutting part 521 due to the movement of the medal M1, the upstream abutting part 511 and the abutting part 521 move in the width direction of the first medal passage part 401 by the pressing of the medal M1. At this time, the downstream abutting part 512 is interlocked with the movement of the upstream abutting part 511 in the width direction of the first medal passage part 401.

Specifically, the above-described first state due to the movement of the medal M1 shifts to a second state from the time when the first portion of the medal M1 contacts the upstream abutting part 511 and the abutting part 521 to the time when the diameter portion of the medal M1 contacts the upstream abutting part 511 and the abutting part 521. In the second state, the downstream abutting part 512, together with the upstream abutting part 511, continues to rotate around the fulcrum 513 in a direction away from the first medal passage part 401. In this manner, the medal M1 stabilizes the moving posture by the contact between the upstream abutting part 511 and the abutting part 521. Further, in this case, the abutting part 521 may not have to be adopted. Further, in the second state, the medal sensor 34 does not detect the medal M1. As illustrated in FIG. 11, the lever sensor 35 does not detect the protrusion 518 at the undetectable position when the diameter portion of the medal M1 contacts the upstream abutting part 511.

Next, as the medal M1 continues to move, the above-described second state shifts to a third state where the second portion of the medal M1 contacts the upstream abutting part 511 and the abutting part 521 and the first portion of the medal M1 does not abut against the downstream abutting part 512. In the third state, the downstream abutting part 512, together with the upstream abutting part 511, continues to rotate around the fulcrum 513 in a direction of approaching from the first medal passage part 401. Further, in the third state, the medal sensor 34 detects the medal M1. The lever sensor 35 detects the protrusion 518 returning from the undetectable position to the detectable position.

Subsequently, when the medal M1 further moves, the above-described third state shifts to a fourth state where the medal M1 reaches the predetermined position B at the center of the upstream abutting part 511 and the downstream abutting part 512, and while the first portion of the medal M1 contacts the downstream abutting part 512, the second portion of the medal M1 contacts the upstream abutting part 511. In this case, the medal M1 does not come into contact with the abutting part 521. In the fourth state, the upstream abutting part 511 and the downstream abutting part 512 are urged to press the medal M1 against the second side wall surface 462 as illustrated in FIG. 10. In this case, the medal M1 is in a state where slight movement is possible. Accordingly, the medal M1 can be restrained in a short time by the upstream abutting part 511, the downstream abutting part 512, and the second side wall surface 462, and the movement is slightly suppressed. In this manner, in the fourth state, the medal sensor 34 can detect the medal M1 passing through the predetermined position B, and the lever sensor 35 detects the protrusion 518 at the detectable position. Further, in the fourth state, the movement of the medal M1 is slightly suppressed by the upstream abutting part 511 and the downstream abutting part 512, such that the lever sensor 35 can reliably detect the protrusion 518 and can accurately calculate the number of medals M1.

Immediately after the medal M1 is restrained, the first portion of the medal M2 starts to abut against the upstream abutting part 511. In this manner, the upstream abutting part 511 and the downstream abutting part 512 continue to rotate in the direction of being separated from the first medal passage part 401, similarly to the above-described second state of the medal M1. Accordingly, the downstream abutting part 512 retracts to the outside of the first medal passage part 401 and is in a state of not being in contact with the medal M1. At the same time, the medal M1 of which the movement is slightly suppressed is pressed by the moving medal M2 to be separated from the upstream abutting part 511. In other words, as illustrated in FIG. 11, in this case, both the upstream abutting part 511 and the downstream abutting part 512 are in the fifth state of not being in contact with the medal M1, and the load on M1 is released. Therefore, the movement of the medal M1 is allowed. Accordingly, as illustrated in FIG. 12, the medal M1 can move at high speed toward the second medal passage part 402 by the force received from the medal M2. Further, in the fifth state, the medal sensor 34 does not detect the medal M1. The lever sensor 35 detects the protrusion 518 at the detectable position.

Further, when the medal M1 flows into the second medal passage part 402, the moving direction of the medal M1 is restricted by the guidance of the protrusion 556 of the second guider 55, and the medal M1 can flow into the upstream side of the second medal passage part 402 from the upstream end portion 404 of the second medal passage part 402. Furthermore, by the third guider 60 provided at the upper part of the second medal passage part 402, movement in a stable state is possible without bouncing on the second medal passage part 402.

In addition, from the medal M2 to a medal M6, the upstream abutting part 511 and the downstream abutting part 512 operate in the same manner as that in the above-described second state to fifth state. When the medal M6 reaches the predetermined position B, for example, the lever sensor 35 transmits the information on the number of medals to the control unit 80. Then, the medal hopper 32 is temporarily stopped by the control of the control unit 80. After the first layer MS configured with the medal M1 to the medal M6 is transported to the mounter 10 and the holding surface 211 returns to the second position P2, for example, the medal sensor 34 transmits the information on the absence of the medal M at the predetermined position B to the control unit 80. Then, the operation of the medal hopper 32 is started again by the control of the control unit 80.

Transporter

Figure 13:
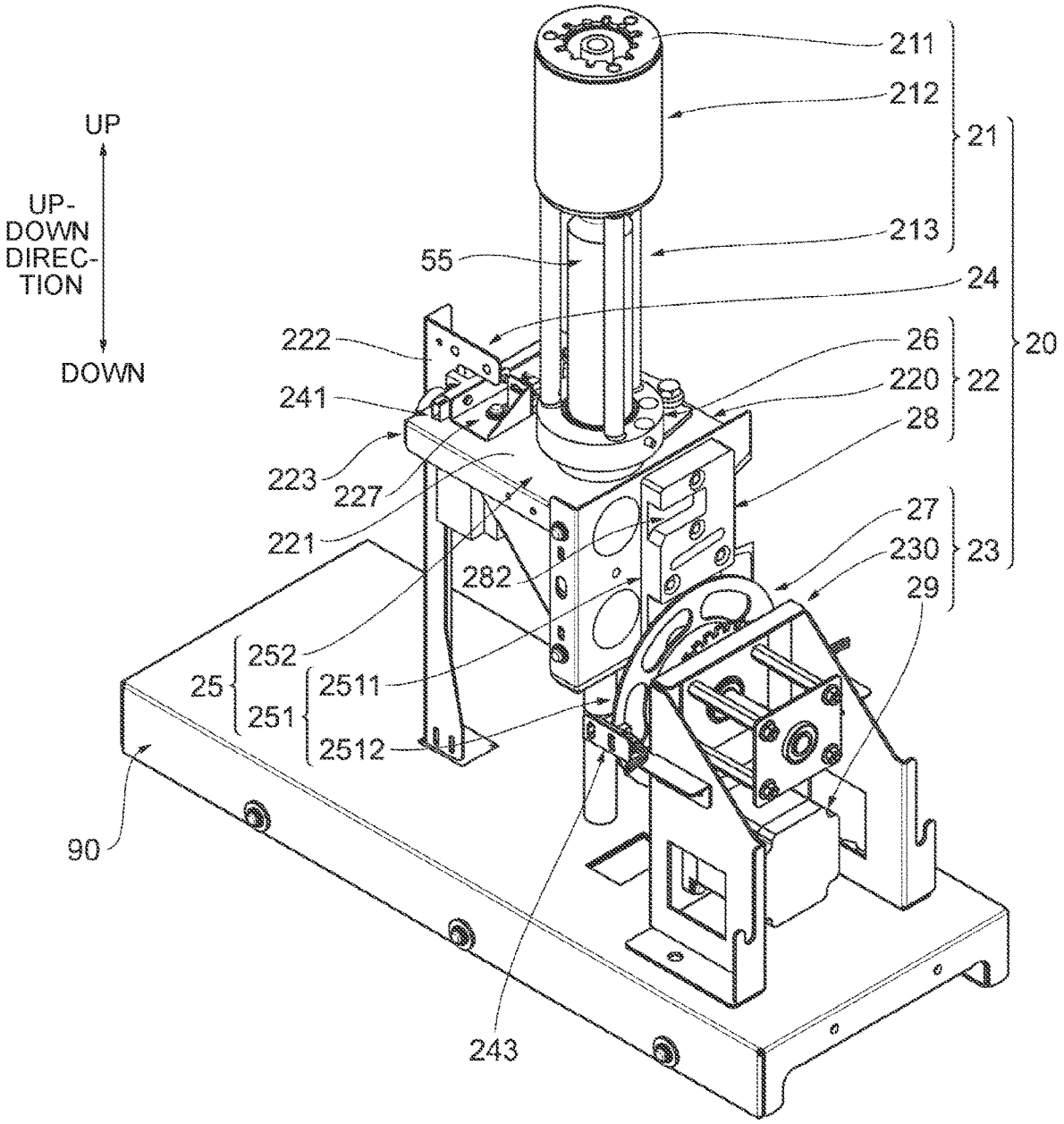
FIG. 13 is a perspective view illustrating a configuration of a transporter of the medal arrangement device according to the present embodiment.
Figure 14:
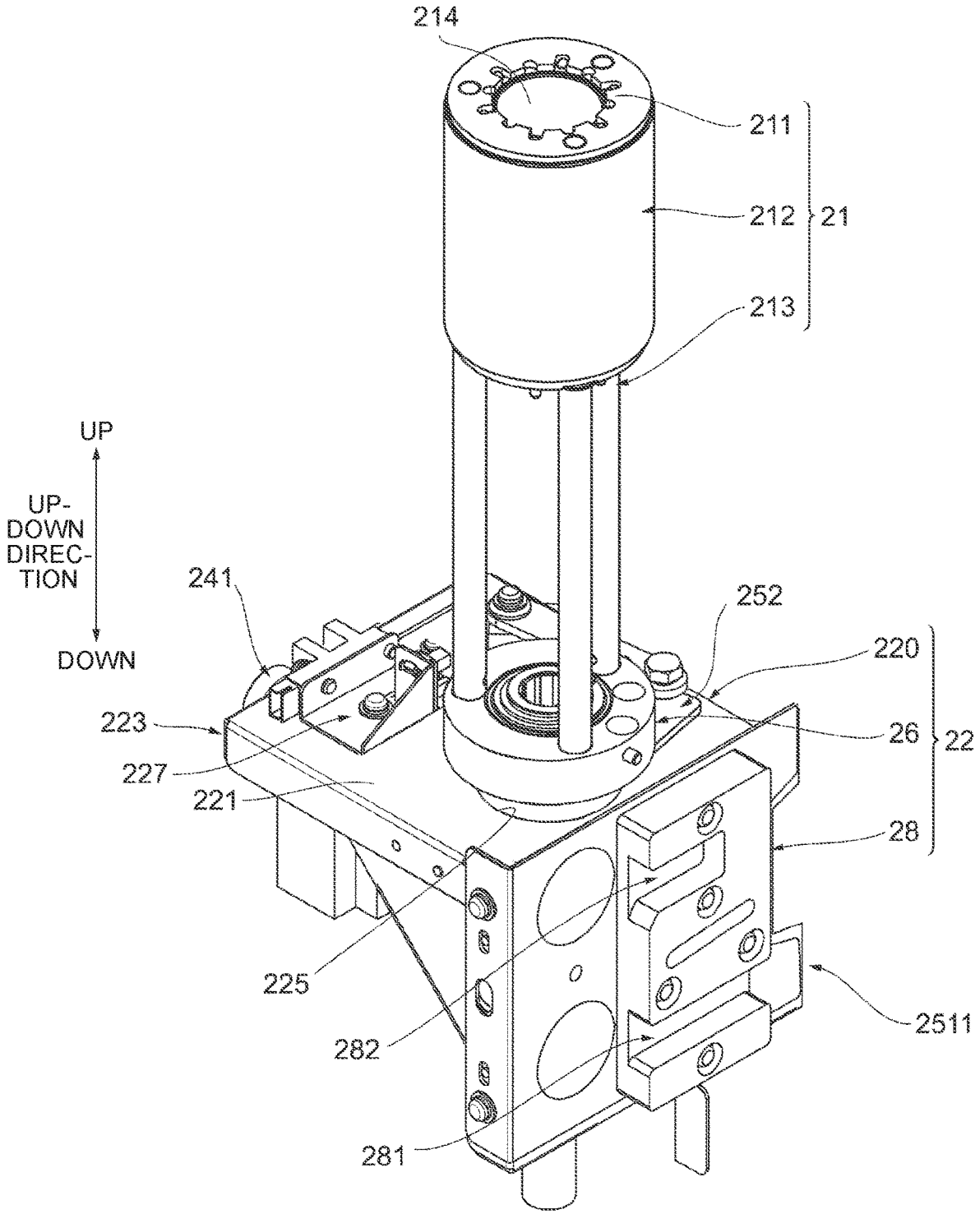
FIG. 14 is a perspective view illustrating a part of a driving configuration of a holder and the transporter of the medal arrangement device according to the present embodiment.
Figure 15:
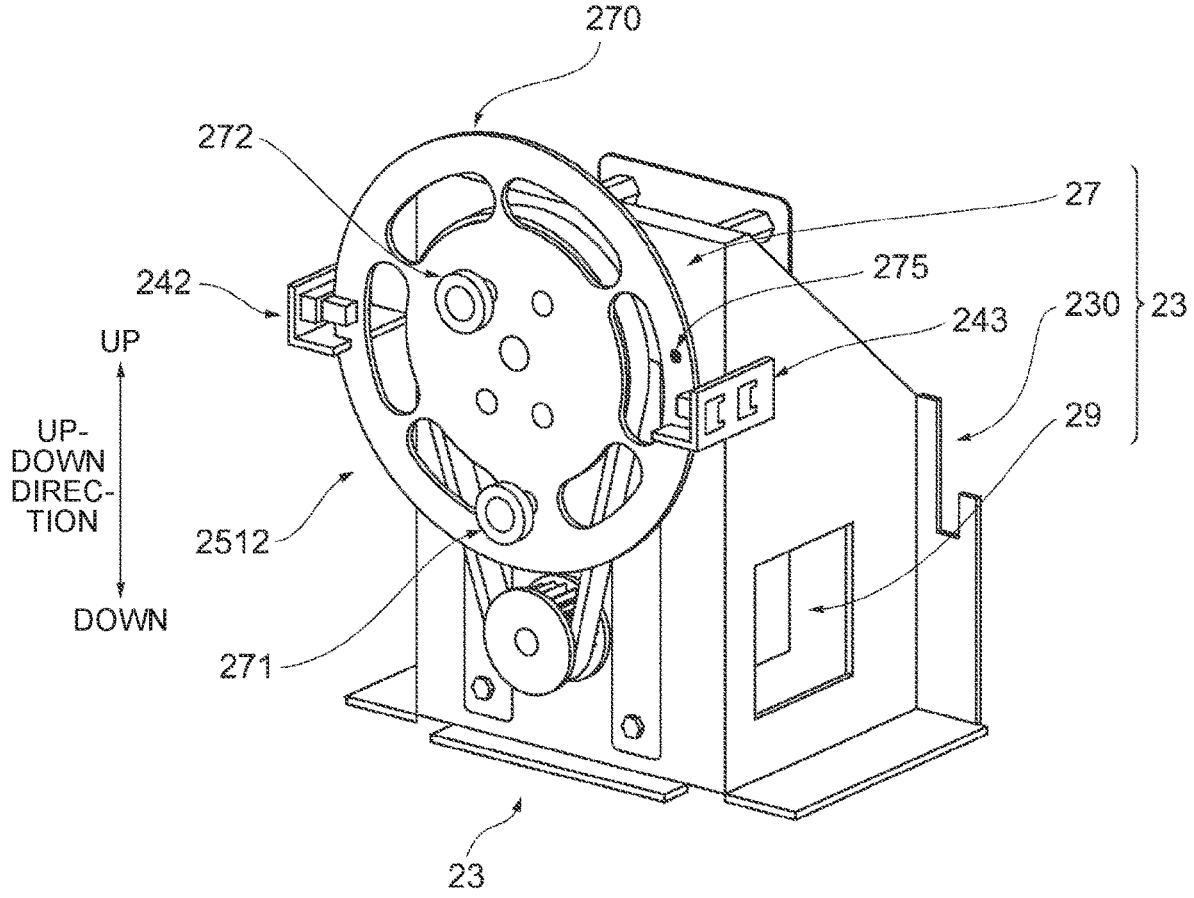
FIG. 15 is a perspective view illustrating another part of the driving configuration of the transporter of the medal arrangement device according to the present embodiment.

Next, the details of the transporter 20 will be described with reference to FIGS. 13 to 18B. In the following description, the operation of the transporter 20 will be described after describing the configuration of the transporter 20. FIG. 13 is a perspective view illustrating the configuration of the transporter 20. FIGS. 14 and 15 are perspective views illustrating a driving configuration of the holder 21 and the transporter 20. FIGS. 16A to 18B are views illustrating each transport state of the transporter 20 and the state of a position sensor 24.

As illustrated in FIG. 5, the transporter 20 includes the holder 21 for holding the single-layer medal set M; a lift table 22 and a lift crank 23 for moving and rotating the holder 21; and the position sensor 24 for detecting the position of the holding surface 211.

Here, the lift table 22 and the lift crank 23 configure an actuator 25 (refer to FIG. 13) of the holder 21 by being combined with each other. The actuator 25 includes a elevation actuator 251 that moves the holder 21 in the up-down direction; and a rotation actuator 252 that horizontally rotates the holder 21. Further, the elevation actuator 251 includes a first elevation section 2511 provided on the lift table 22; and a second elevation section 2512 provided on the lift crank 23.

Holder

As illustrated in FIGS. 13 and 14, the holder 21 includes the holding surface 211 for holding the single-layer medal set M; a cylindrical holding main body 212; and a support unit 213 for attaching the holding surface 211 and the holding main body 212 to the rotation actuator 252.

As illustrated in FIG. 14, the holding surface 211 is an annular flat surface. A hole portion 214 for passing through the second guider 55 is provided at the center of the holding main body 212. In this manner, the holder 21 can move up and down around the second guider 55 without interfering with the second guider 55.

Lift Table

As illustrated in FIGS. 13 and 14, the lift table 22 includes a rotating unit 26 that configures the rotation actuator 252; a positioning plate 28 that configures the first elevation section 2511; and an attaching unit 220 for attaching the rotating unit 26 and the positioning plate 28.

The attaching unit 220 includes a lift guide 222 fixed to the housing 90; and a base portion 223 attached to the lift guide 222 so as to be movable up and down with respect to the lift guide 222. The base portion 223 has an upper surface 221 and a hole portion 225 provided on an upper surface 221.

The rotating unit 26 is configured to rotate the holder 21. As illustrated in FIG. 13, the rotating unit 26 is linked to the support unit 213 of the holder 21. Further, the rotating unit 26 is rotatably attached to the central axis of the housing 90 via a fixing unit (not illustrated). In addition, the rotating unit 26 is provided so as to pass through the hole portion 225 of the base portion 223. In this manner, the rotating unit 26 can prevent interference with the up-down movement of the base portion 223.

The positioning plate 28 is configured to determine the position of a cam 27 of the lift crank 23, which will be described later. As illustrated in FIG. 14, the positioning plate 28 is attached to the side surface of the base portion 223. Further, the positioning plate 28 has a plate shape and has a first groove 281 formed on the lower side and a second groove 282 formed on the upper side. The first groove 281 and the second groove 282 mesh with a first lift roller 271 and a second lift roller 272 of the lift crank 23, which will be described later, by three patterns to realize the up-down movement of the lift table 22.

Lift Crank

As illustrated in FIGS. 13 and 15, the lift crank 23 includes an actuator 29 that configures the elevation section 2512 and drives rotation of the cam 27; and an attaching unit 230 for attaching the cam 27 and the actuator 29.

As illustrated in FIG. 15, the cam 27 includes a rotatable disk portion 270; and the first lift roller 271 and the second lift roller 272 provided on the disk portion 270. Further, a detection hole 275 is provided on the circumferential edge side of the disk portion 270.

The first lift roller 271 and the second lift roller 272 mesh with the first groove 281 and the second groove 282 of the positioning plate 28 to form a cam configuration of the elevation actuator 251. As illustrated in FIG. 15, the first lift roller 271 and the second lift roller 272 are provided on one straight line passing through the rotation center of the disk portion 270 when the disk portion 270 is viewed in a plan view. Specifically, the first lift roller 271 is provided on the circumferential edge side of one side of the rotation center of the disk portion 270, and the second lift roller 272 is provided on the circumferential edge side of the other side of the rotation center of the disk portion 270 and at a position close to the rotation center. In this manner, the first lift roller 271 and the second lift roller 272 configure both ends in the long diameter direction of the cam.

Position Sensor

Figure 17A:
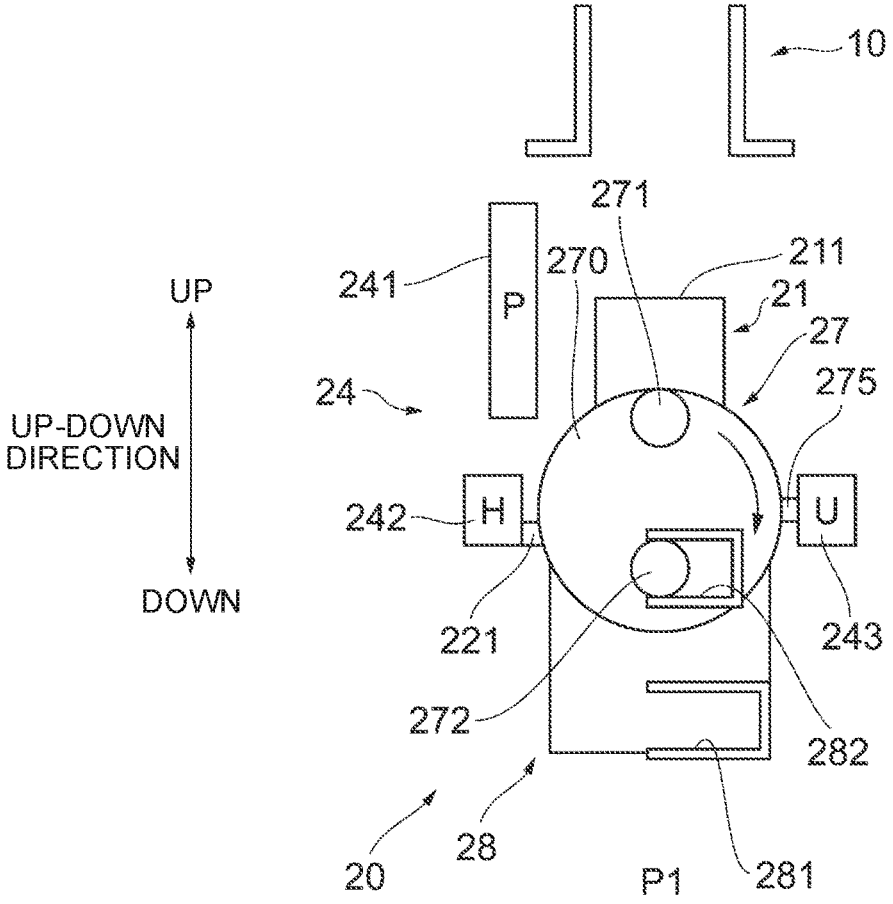
FIG. 17A is a view illustrating a state of a sensor of FIG. 16A.
Figure 17B:
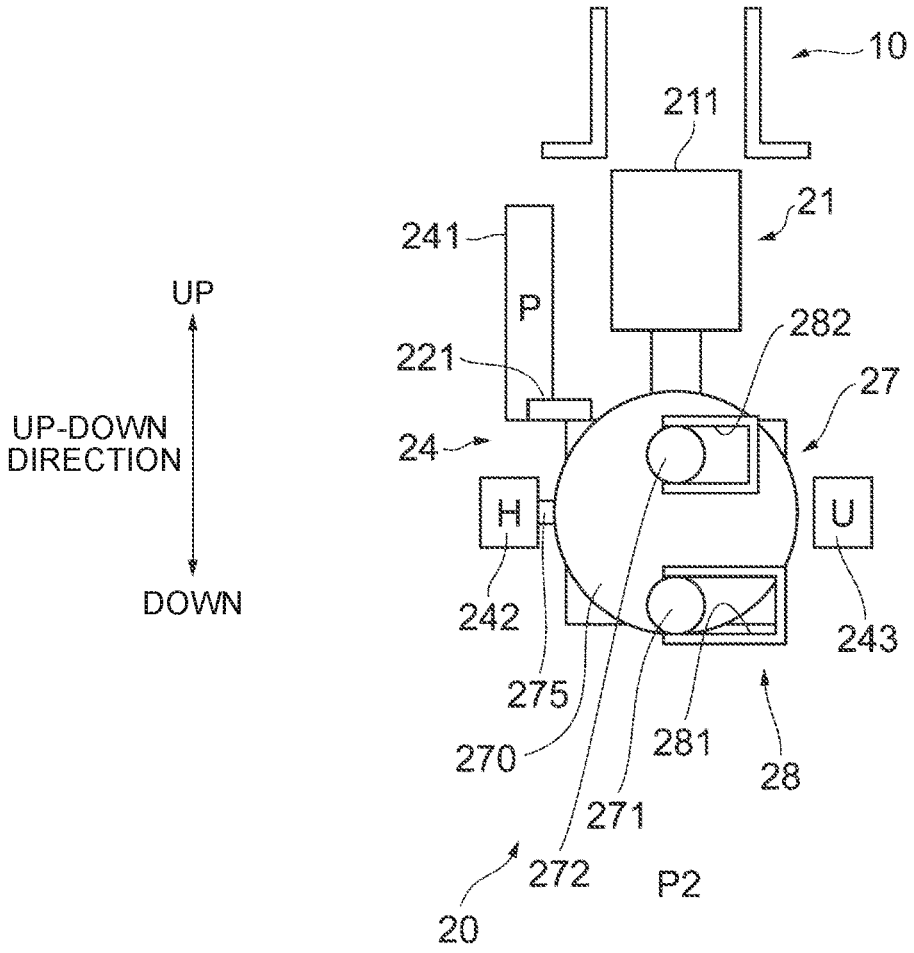
FIG. 17B is a view illustrating a state of the sensor of FIG. 16B.
Figure 17C:
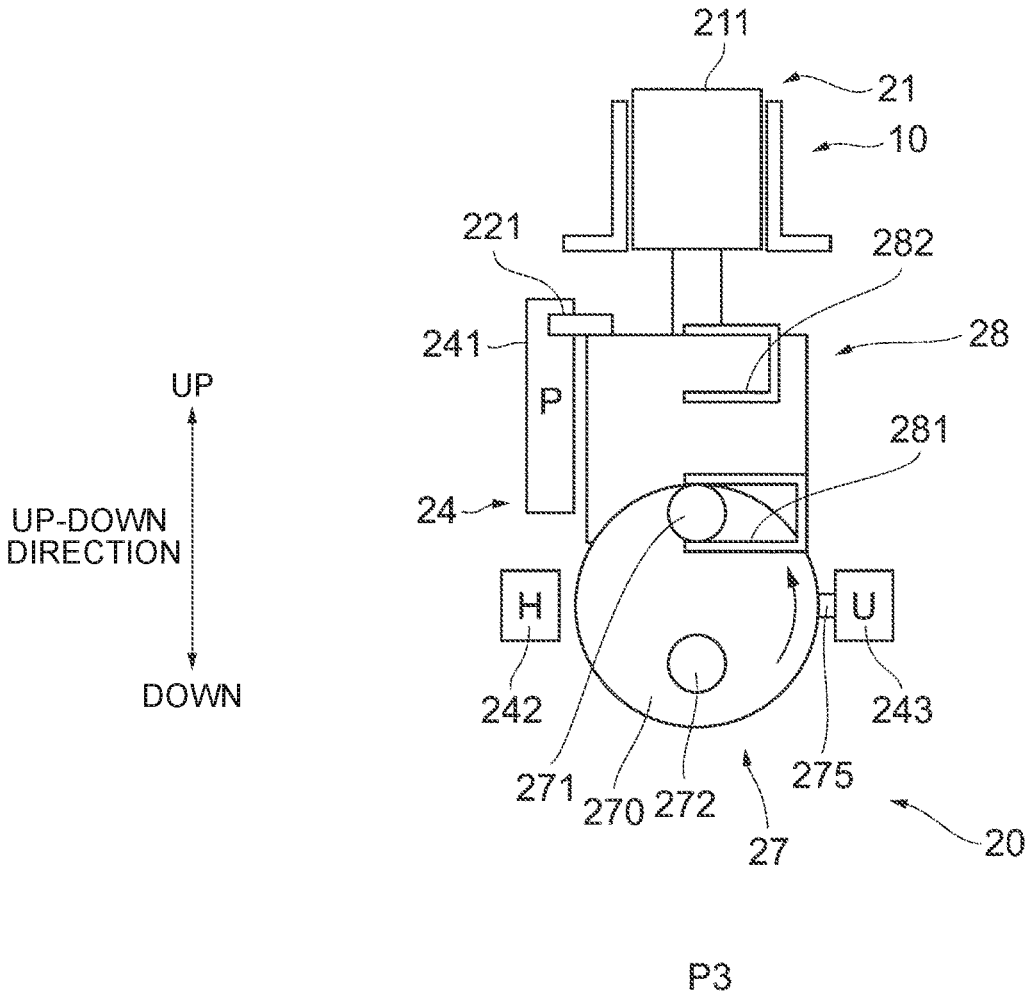
FIG. 17C is a view illustrating a state of the sensor of FIG. 16C.

The position sensor 24 is configured to detect the position of the holding surface 211 by detecting the positions of each of the upper surface 221 of the attaching unit 220 and the detection hole 275 of the disk portion 270. As illustrated in FIGS. 17A to 17C, the position sensor 24 includes a first position sensor 241 for detecting the position of the upper surface 221 of the attaching unit 220; a second position sensor 242 for detecting one position of any of the upper surface 221 of the attaching unit 220 and the detection hole 275 of the disk portion 270; and a third position sensor 243 for detecting the position of the detection hole 275 of the disk portion 270.

The first position sensor 241, the second position sensor 242, and the third position sensor 243 are all turned on in a case where the detection target is detected, and turned off in a case where the detection target is not detected. Further, when any two sensors of the first position sensor 241, the second position sensor 242, and the third position sensor 243 are turned on when the positions of the upper surface 221 of the attaching unit 220 and the detection hole 275 of the disk portion 270 are detected, it is possible to detect the position of the holding surface 211.

In the assembled state, the first position sensor 241 is fixed to a bracket 227 attached to the upper surface 221 of the attaching unit 220, as illustrated in FIG. 13. As illustrated in FIG. 15, the second position sensor 242 and the third position sensor 243 are fixed to the attaching unit 230 so as to be positioned on both sides of the disk portion 270 of the cam 27 in the horizontal radial direction.

Operation of Transporter

Next, the operation of the transporter 20 will be described with reference to FIGS. 16A to 18B. In FIGS. 16A to 18B, the display of a partial configuration of the lift crank 23 will be omitted. Further, in order to clearly illustrate the relationship of the detection holes 275 and the upper surface 221 and the on/off state of each sensor of the position sensor 24, FIGS. 17A to 18B illustrate that both the detection hole 275 and the upper surface 221 are different from the actual shapes, and are projected from the base portion 223 and the disk portion 270. Further, the first position sensor 241 is displayed so as to be separated from the upper surface 221 unlike the actual attachment.

Figure 16A:
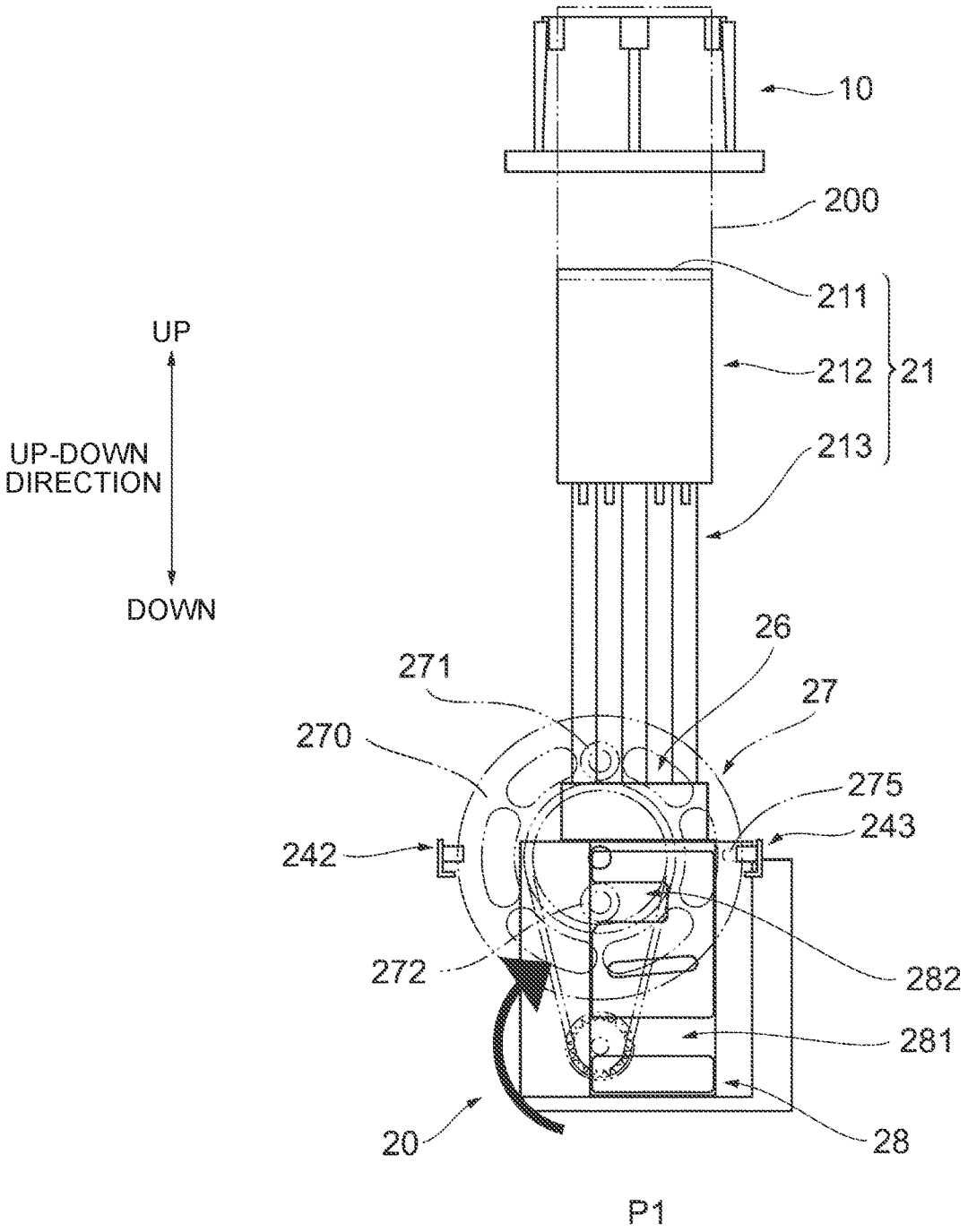
FIG. 16A is a view illustrating a transport state of the transporter of the medal arrangement device according to the present embodiment at a first position.

In the present embodiment, the holding surface 211 is positioned at the first position P1 before the transporter 20 is operated. In this case, the holding surface 211 may be positioned at the second position P2 or the third position P3. When the holding surface 211 is positioned at the first position P1, as illustrated in FIGS. 16A and 17A, the second lift roller 272 of the cam 27 meshes with the second groove 282 of the positioning plate 28, but the first lift roller 271 of the cam 27 does not mesh with the first groove 281 of the positioning plate 28. Therefore, the third position sensor 243 detects the detection hole 275 and is turned on. Meanwhile, the first position sensor 241 and the second position sensor 242 are turned off. In this manner, the control unit 80 can confirm that the holding surface 211 is positioned at the first position P1.

Figure 16B:
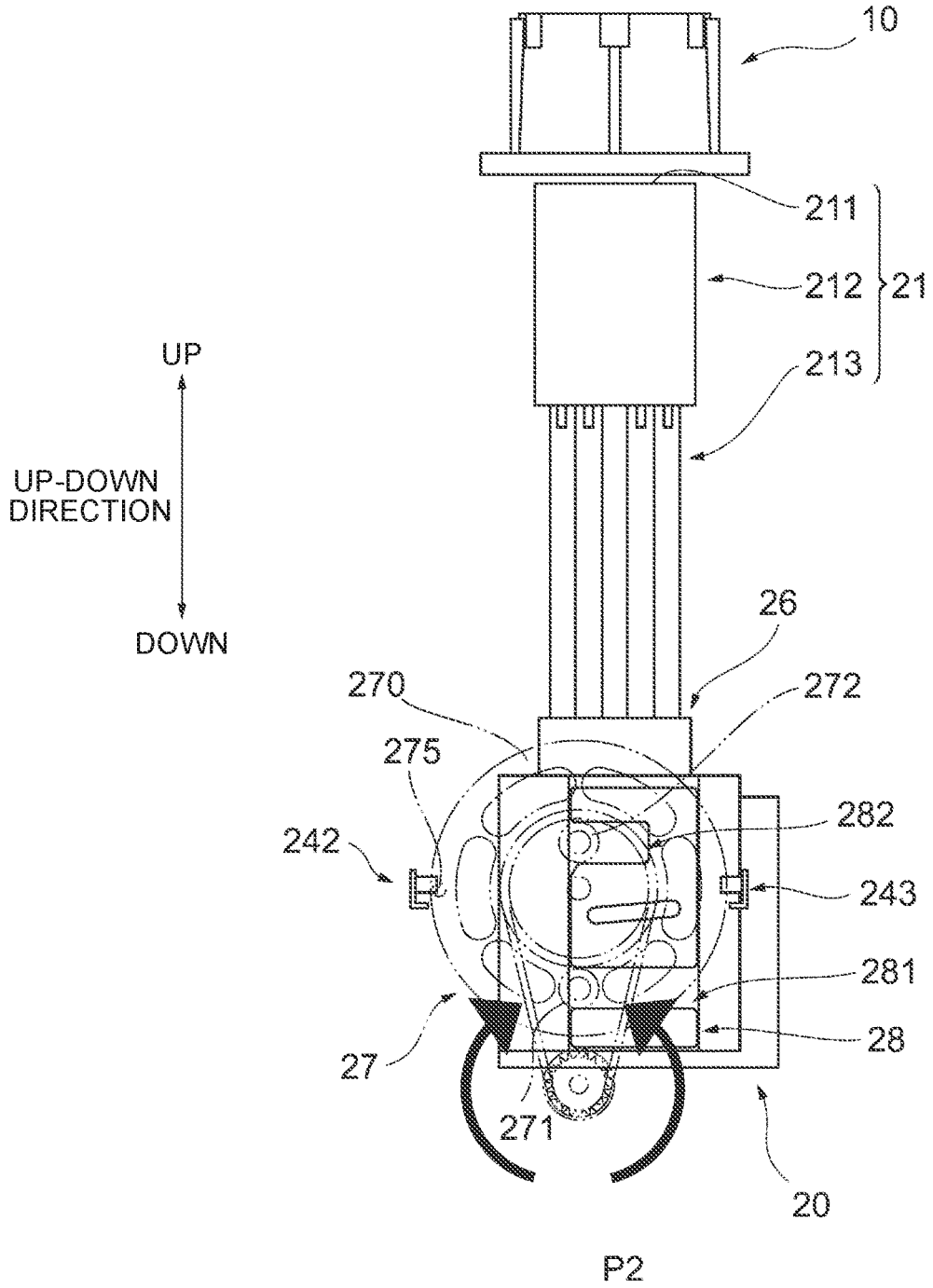
FIG. 16B is a view illustrating a transport state of the transporter of the medal arrangement device according to the present embodiment at a second position.

Based on the control of the control unit 80, the transporter 20 starts to operate. First, when the actuator 29 is activated, the cam 27 rotates so as to raise the holding surface 211 from the first position P1 to the second position P2. In this case, the cam 27 rotates around the second lift roller 272 that meshes with the second groove 282 such that the first lift roller 271 meshes with the first groove 281. Then, as illustrated in FIGS. 16B and 17B, when the first position sensor 241 detects the upper surface 221 and is turned on, the second position sensor 242 detects the detection hole 275 and is turned on, and the third position sensor 243 is turned off, the control unit 80 can confirm that the first lift roller 271 meshes with the first groove 281, the second lift roller 272 meshes with the second groove 282, and the holding surface 211 reaches the second position P2. In this case, the actuator 29 is stopped by the control of the control unit 80. In this manner, the raising of the lift table 22 is stopped, and the posture in which the holding surface 211 is positioned at the second position P2 can be maintained. Accordingly, the supplier 30 can provide the medal M on the holding surface 211 having a stable state.

Figure 16C:
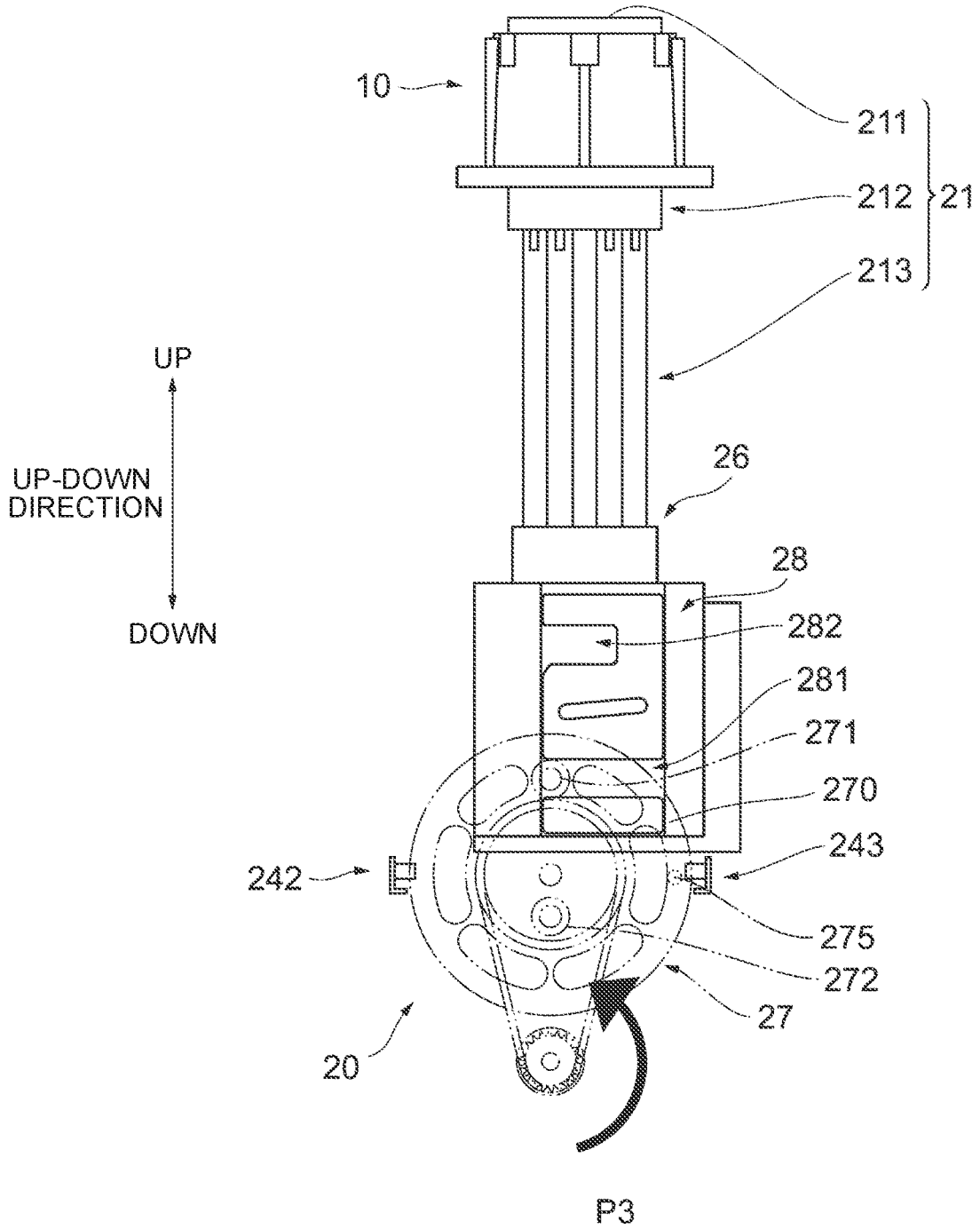
FIG. 16C is a view illustrating a transport state of the transporter of the medal arrangement device according to the present embodiment at a third position.

Subsequently, when the actuator 29 is reactivated, the cam 27 rotates so as to raise the holding surface 211 from the second position P2 to the third position P3. In this case, the cam 27 rotates around the second lift roller 272 that meshes with the second groove 282 such that the meshed state of the second lift roller 272 and the second groove 282 is disengaged. Then, as illustrated in FIGS. 16C and 17C, when the first position sensor 241 detects the upper surface 221 of the attaching unit 220 and is turned on, the third position sensor 243 detects the detection hole 275 of the cam 27 and is turned on, and the second position sensor 242 is turned off, the control unit 80 can confirm that the first lift roller 271 meshes with the first groove 281, the meshed state of the second lift roller 272 and the second groove 282 is disengaged, and the holding surface 211 reaches the third position P3. In this case, the actuator 29 is stopped by the control of the control unit 80. In this manner, the raising of the lift table 22 is stopped, and the posture in which the holding surface 211 is positioned at the third position P3 can be maintained. Further, when the holding surface 211 is positioned at the third position P3, the rotating unit 26 rotates the holding surface 211. Accordingly, the mounting position of the single-layer medal set MS on the mounting surface 111 can be adjusted.

After this, when the actuator 29 is reactivated, the cam 27 rotates in a reverse direction so as to lower the holding surface 211 from the third position P3 to the second position P2. In this case, the cam 27 rotates around the second lift roller 272 such that the second lift roller 272 meshes with the second groove 282. Then, as illustrated in FIGS. 16B and 17B, when the first position sensor 241 detects the upper surface 221 and is turned on, the second position sensor 242 detects the detection hole 275 and is turned on, and the third position sensor 243 is turned off, the control unit 80 can confirm that the first lift roller 271 meshes with the first groove 281, the second lift roller 272 meshes with the second groove 282, and the holding surface 211 is lowered to the second position P2. In this case, the actuator 29 is stopped by the control of the control unit 80. In this manner, the lowering of the lift table 22 is stopped, and the posture in which the holding surface 211 is positioned at the second position P2 can be maintained. Accordingly, the holder 21 can mount the single-layer medal set MS on the mounting surface 111 in the lowering process, and after the holding surface 211 returns to the second position P2, the supplier 30 can provide the medal M to the holding surface 211 again and configure the next single-layer medal set MS.

Figure 18A:
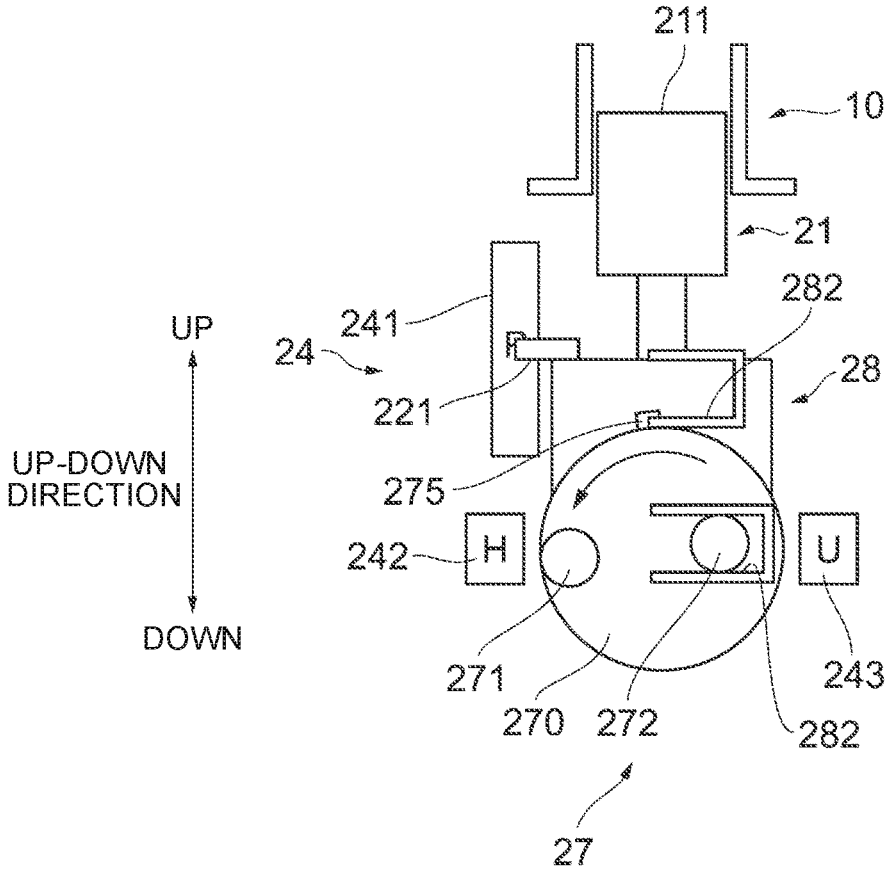
FIG. 18A is a view illustrating a state where the sensor of the transporter of the medal arrangement device according to the present embodiment cannot measure the position of the transporter.
Figure 18B:
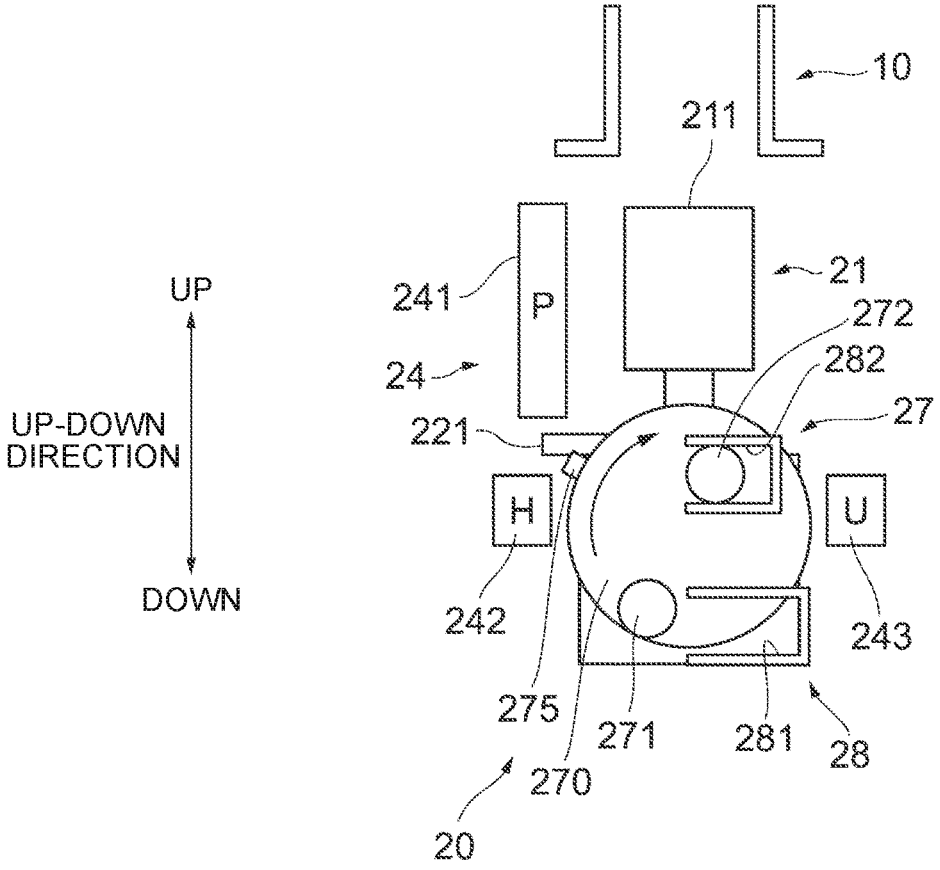
FIG. 18B is a view illustrating a state where the sensor of the transporter of the medal arrangement device according to the present embodiment cannot measure the position of the transporter.

In this manner, when repeating the above-described operation, the transporter 20 can configure the medal tower MT by transporting and mounting the plural layers of single-layer medal sets MS to the mounter 10. As illustrated in FIGS. 18A and 18B, in a case where only one of the first position sensor 241 and the second position sensor 242 is turned on, or both the first position sensor 241 and the third position sensor 243 are turned off, the control unit 80 determines that the position sensor 24 has not detected the position of the holding surface 211. In this case, based on the detection of the control unit 80, the cam 27 further rotates to find the correct position.

In this case, by adopting a simple cam configuration, the transporter 20 stops only at each of the first position P1, the second position P2, and the third position P3, which are required to configure the medal tower MT, and accordingly, the formation of the medal tower MT is realized. In this manner, as compared with a case of adopting the worm gear, the transporter 20 that adopts the cam configuration realizes simplification and miniaturization of the transport structure, and accordingly, it is possible to simplify the control related to the transport and reduce the manufacturing costs. As a result, the transporter 20 having excellent durability and productivity can be obtained.

Collector

The details of the collector 70 will be described with reference to FIGS. 4 and 5. The collector 70 is a mechanism for quickly collecting the medals M remaining in the device when a specific event (for example, a power failure during the stacking operation of medals) occurs. As illustrated in FIGS. 4 and 5, the collector 70 includes a collection mechanism 71 for collecting the medals M remaining on the holding surface 211 when a specific event occurs; a collection box 72 for collectively storing the medals M collected by the collection mechanism 71; and a collection guider 73 for guiding the medals M such that the medals M dropped from the holding surface 211 are stored in the collection box 72. The collection mechanism 71 has a configuration (not illustrated) for pushing down the medals M remaining on the holding surface 211. The collection guider 73 has a plate member that is diagonally inclined such that the medal M pushed down by the collection mechanism 71 slides down into the collection box 72. The collection box 72 is provided below the collection guider 73. Further, the collection box 72 is configured to be detachable. In this manner, the medal M stored in the collection box 72 can be easily collected.

Control Unit

Figure 19:
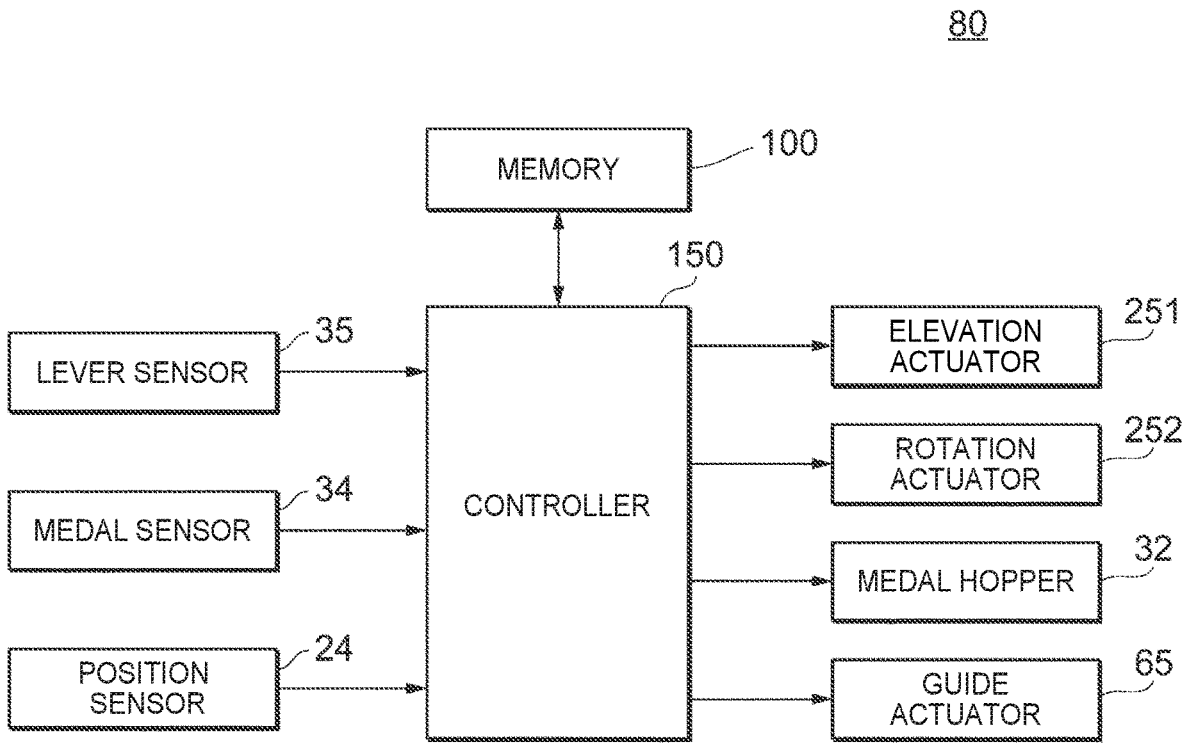
FIG. 19 is a block diagram for describing a configuration of a controller of the medal game machine according to the present embodiment.
Figure 20:
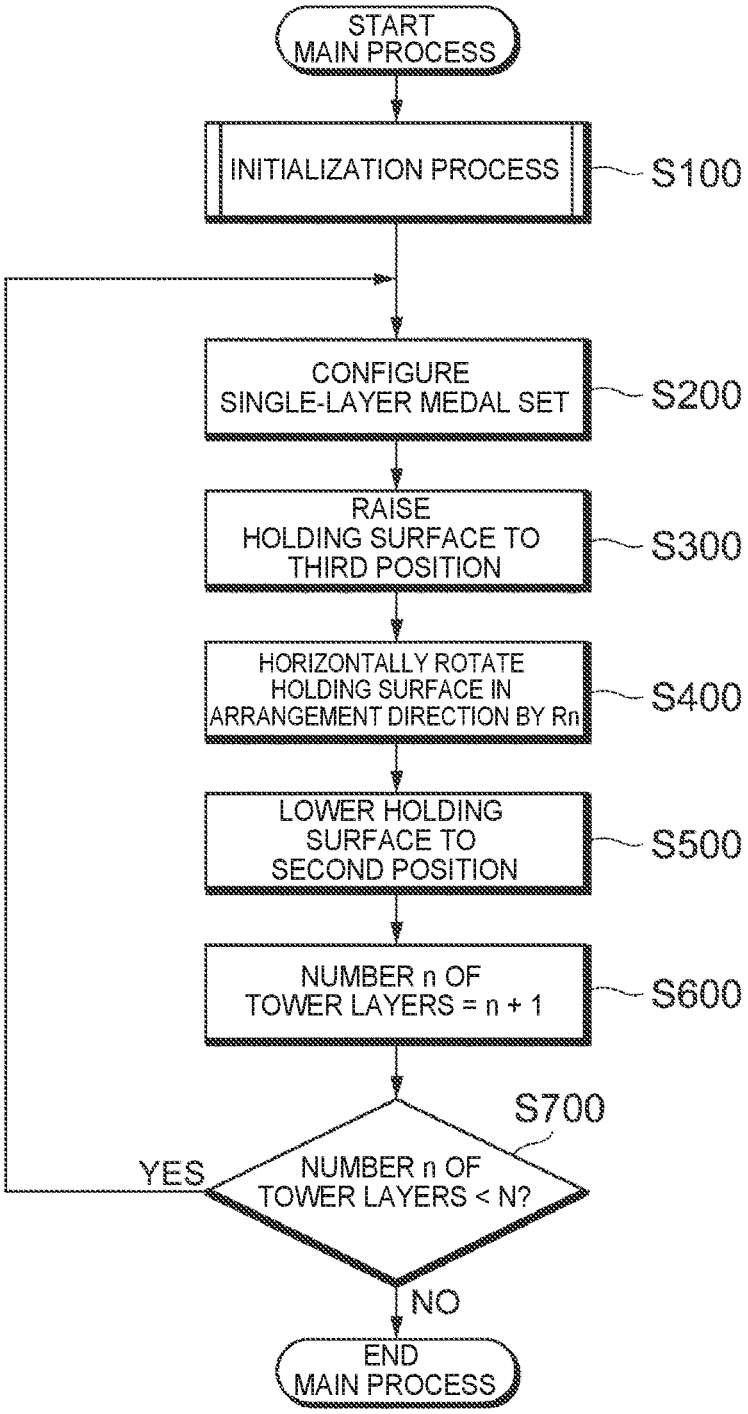
FIG. 20 is a flowchart for describing control for forming a medal tower by the controller of the medal game machine according to the present embodiment.

Next, the details of the control unit 80 will be described with reference to FIGS. 19 to 25. Hereinafter, the configuration of the control unit 80 will be described, and then the control by the control unit 80 will be described in detail. FIG. 19 is a block diagram for describing the configuration of the control unit 80. FIG. 20 is a flowchart for describing control for forming the medal tower MT by the control unit 80. FIGS. 21 to 25 are respectively views for describing the details of step S100 in FIG. 20, the control according to step S300, the control according to step S400, the control according to step S500, and the control according to step 600. In the following description, the process of forming the medal tower MT may be referred to as "main process".

Configuration of Control Unit

First, the configuration of the control unit 80 will be described with reference to FIG. 19. The control unit 80 is configured to control the overall operation of the medal arrangement device 5. As illustrated in FIG. 19, the control unit 80 includes a memory 100 for storing various data; and the controller 150 for controlling various driving devices.

The memory 100 stores various information such as the number n of tower layers, the maximum number N of layers of the medal tower MT, and the rotation angles R1 to Rn of the holding surfaces 211 in each layer of the medal tower MT. Here, for example, "R1=30" indicates that the stacked medals M are horizontally rotated in the arrangement direction using a centripetal angle of 30°. Further, each value of the rotation angles R1 to Rn can be set from −30 to +30, and in a case where the rotation angles R1 to Rn are positive values, the holder 21 horizontally rotates in a clockwise direction, and in a case where the rotation angles R1 to Rn are negative values, the holder 21 rotates horizontally in a counterclockwise direction.

In addition, in the present embodiment, the rotation angles R1 to Rn are set, but the distance and direction in which the stacked medals M move horizontally may be set. Further, the maximum number N of layers, the rotation angles R1 to Rn, or the distance and direction of horizontal movement may be predetermined values in the memory 100 in advance, or may be set by a DIP switch or the like (not illustrated). In a case of setting by the DIP switch or the like, the controller 150 reads the value of the DIP switch and determines each value.

Control by Control Unit

Next, with reference to FIGS. 20 to 25, the control by the control unit 80, that is, the main process performed by the controller 150 of the control unit 80 based on the data stored in the memory 100 will be described in detail. Hereinafter, the mounting of the first layer MS will be described as an example. Since the mounting of the second layer MS to the N-th layer MS is the same as the mounting of the first layer MS, the description of the mounting will be simplified.

Step S100

First, the controller 150 performs an initialization process.

Figure 21:
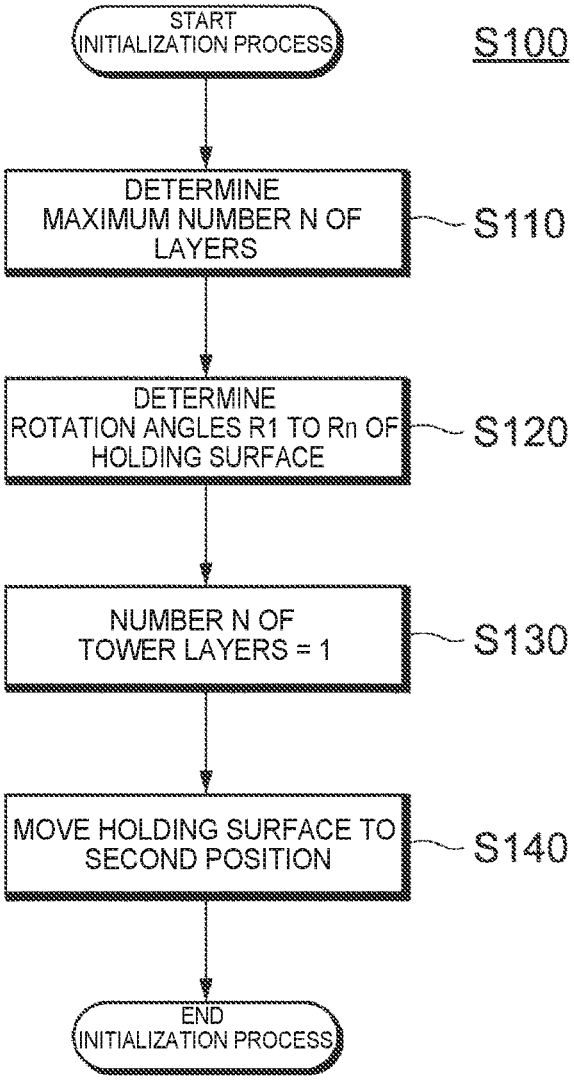
FIG. 21 is a flowchart for describing the details of step S100 of FIG. 20.

Specifically, as illustrated in FIG. 21, the controller 150 first determines the maximum number N of layers of the medal tower and stores the determined maximum number in the memory 100 (step S110). Next, the controller 150 sets the rotation angles R1 to Rn of the holding surface 211 in each stage of the medal tower MT and stores the set rotation angles in the memory 100 (step S120). Subsequently, the controller 150 initializes the number n of generated medal tower layers to 1 (step S130). After this, the controller 150 drives the elevation actuator 251 to move the holding surface 211 to the second position P2 based on the information transmitted from the first position sensor 241 (step S140). When the holding surface 211 reaches the second position P2, the second medal passage part 402 is configured. In this manner, the controller 150 ends the initialization process.

In addition, in the present embodiment, the holding surface 211 has been described as being moved to the second position P2 in step S140, but the holding surface 211 may be moved to the first position P1 or the third position P3 as necessary.

Step S200

Next, the controller 150 performs a configuration process of the single-layer medal set MS.

Specifically, the controller 150 drives the supplier 30, specifically, the motors (not illustrated) of the guide actuator 65 and the medal hopper 32, to configure the single-layer medal set MS (here, corresponding to the first layer MS) on the holding surface 211 of the second medal passage part 402. The details of the operation of the supplier 30 are the same as those described in the operation description of the supplier 30 described above, and thus, the description of the details of the operation will be omitted here.

Step S300

Figure 22:
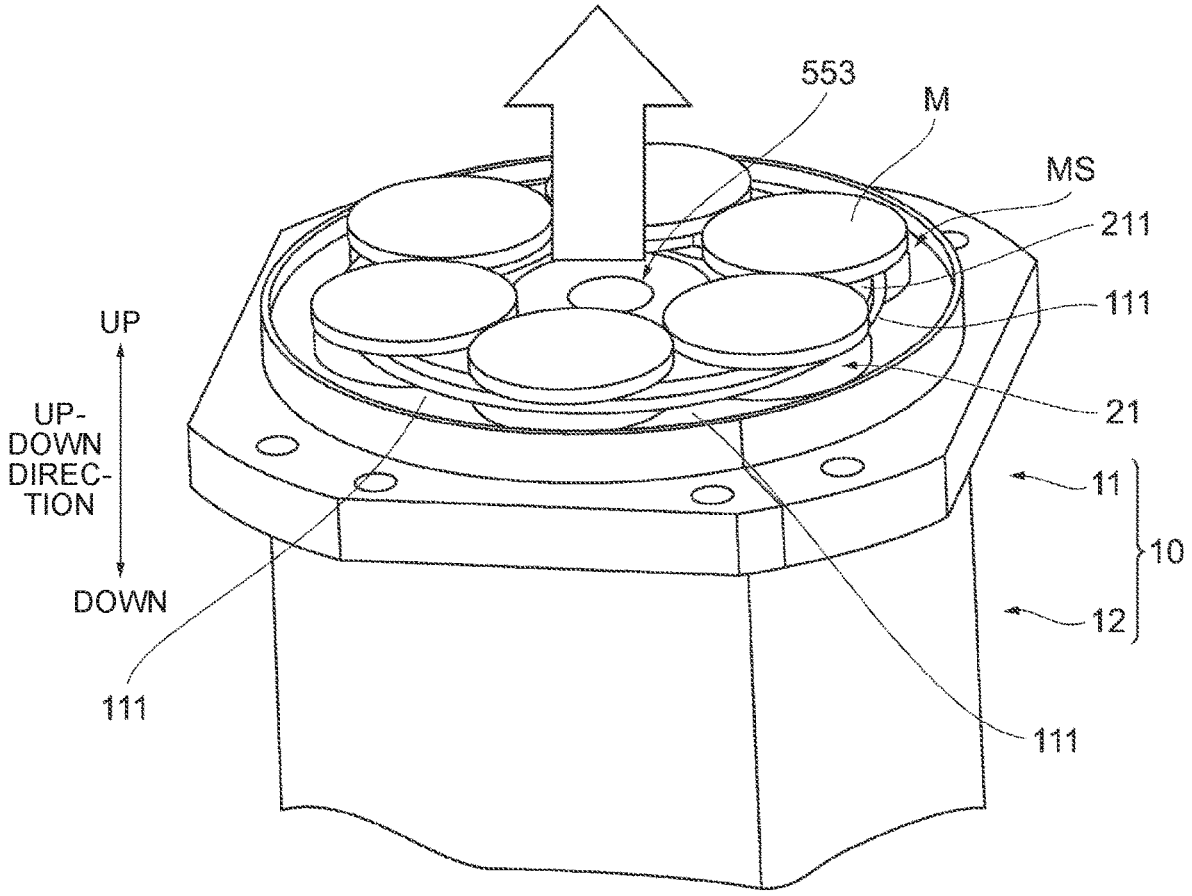
FIG. 22 is a view for describing the control according to step S300 of FIG. 20.

Subsequently, the controller 150 drives the elevation actuator 251 to raise the holding surface 211 as illustrated in FIG. 22. Specifically, the controller 150 raises the holding surface 211 so as to reach the third position P3 (refer to the position of the holding surface 211 illustrated in FIGS. 16C and 23).

Step S400

Figure 23:
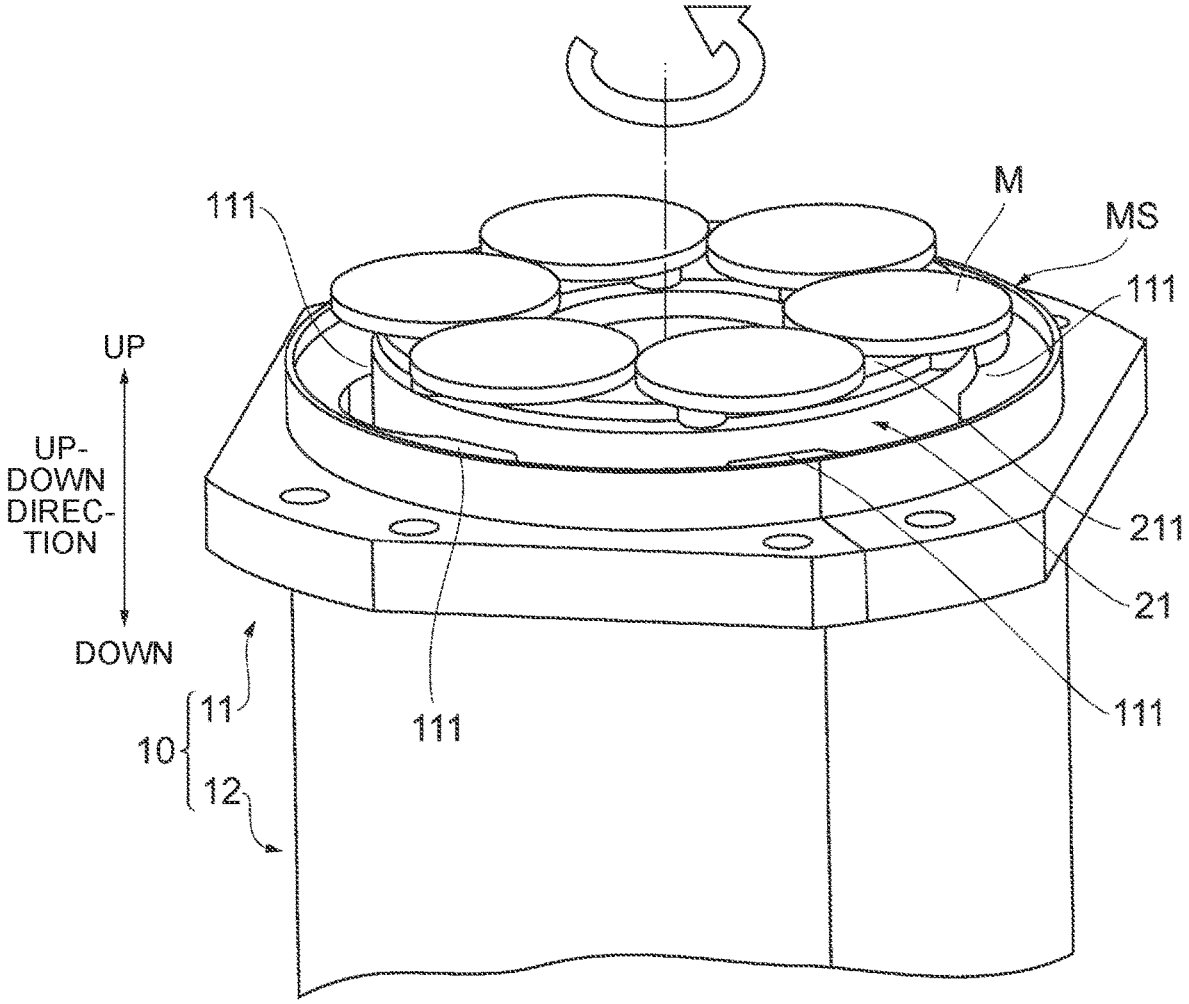
FIG. 23 is a view for describing the control according to step S400 of FIG. 20.
Figure 24:
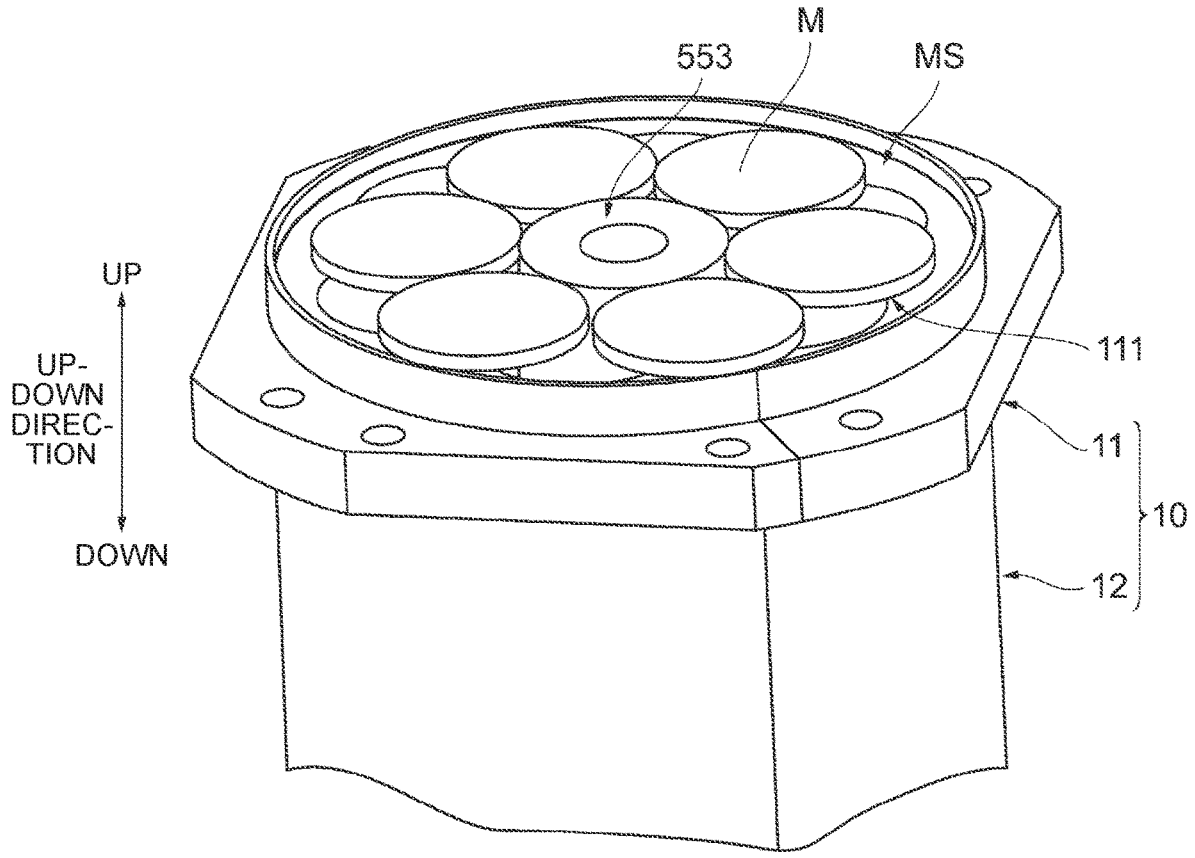
FIG. 24 is a view for describing the control according to step S500 of FIG. 20.

Next, the controller 150 drives the rotation actuator 252 to horizontally rotate the holding surface 211 in the arrangement direction by R1 as illustrated in FIG. 23. Accordingly, the disposing direction is adjusted such that the first layer MS held on the holding surface 211 is positioned above the position that corresponds to the mounting surface 111 of the mounter 10.

Step S500

Subsequently, the controller 150 drives the elevation actuator 251 to lower the holding surface 211 to the second position P2. Accordingly, the first layer MS held on the holding surface 211 is lowered together with the holding surface 211. Further, when passing through the mounting surface 111, the first layer MS remains on the mounting surface 111 by being caught by the mounting surface 111. In this manner, the first layer MS is mounted on the mounting surface 111 of the mounter 10. This first layer MS configures the lowest layer of the incomplete medal tower. Meanwhile, the holder 21 can continue to be lowered toward the second position P2 without interfering with the mounting surface 111.

Step S600

Next, the controller 150 increments the number of tower layers n. In this example, the number n of tower layers changes from "0" to "1".

Step S700

After this, the controller 150 determines whether or not the number n of tower layers (here, "1") has reached the maximum number N of layers.

Since the number n of tower layers is "1", this example corresponds to a case where the number n of tower layers has not reached the maximum number N of layers (Yes in step S700). Then, the controller 150 returns to step S200 and repeats the same process until the maximum number N of layers is reached.

Further, for example, in the second step S300, the holding surface 211 is raised to the third position P3 while holding the second layer MS. The second layer MS held on the holding surface 211 is positioned on the lower surface of the first layer MS, which is the lowest layer of the incomplete medal tower mounted on the mounter 10. Further, since the first layer MS has the same arrangement as that of the second layer MS held on the holding surface 211 and is deviated by a predetermined rotation angle, both have an overlapping region. Accordingly, by raising the second layer MS held on the holding surface 211, the holder 21 lifts up both the second layer MS held on the holding surface 211 and the first layer MS of the incomplete medal tower mounted on the mounter 10 from the overlapping region. In this manner, the second layer MS becomes the new lowest layer of the incomplete medal tower, and a new incomplete medal tower having the number n of tower layers of "2" is configured. Since other processes are the same as those described above, the description of other processes will be omitted.

Figure 25:
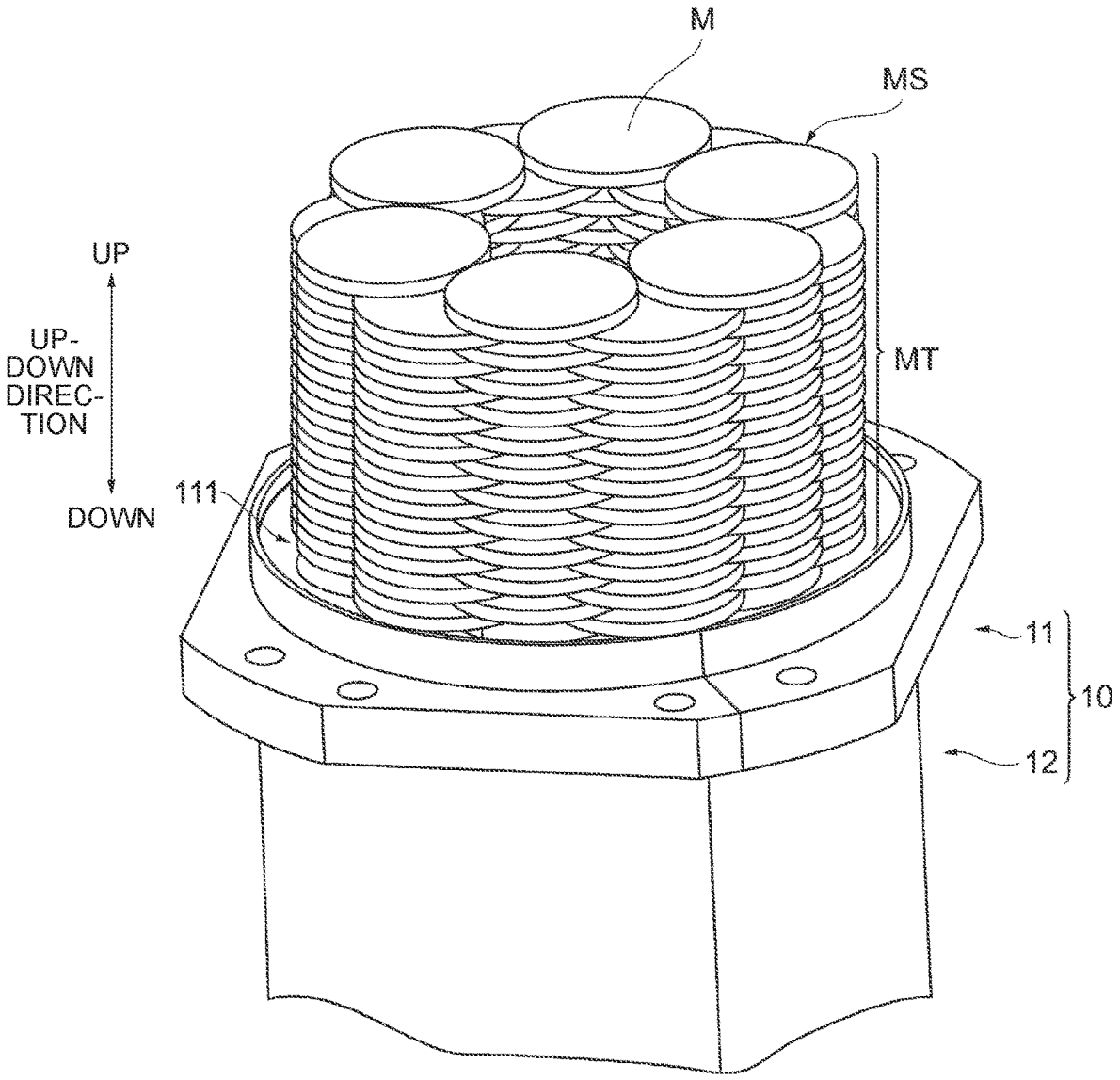
FIG. 25 is a view for describing the control according to step S600 of FIG. 20.

Meanwhile, in a case where the number n of tower layers has reached the maximum number of layers N (No in step S700), the controller 150 ends the main process. Accordingly, as illustrated in FIG. 25, the medal tower MT having the number N of tower layers, that is, the medal tower MT in which each stage horizontally moves in the arrangement direction, is completed.

In the medal arrangement device 5 according to the above-described embodiment, the upstream abutting part 511 and the downstream abutting part 512 can be provided so that: when one medal M ejected from the medal hopper 32 reaches a predetermined position B of the downstream end portion 405, at least a part of the upstream abutting part 511 and at least a part of the downstream abutting part 512 are located in the first medal passage part 401 so as to press the medal M against the second side wall surface 462; and when the medal M passes through the predetermined position B, the downstream abutting part 512 retracts to an outside of the first medal passage part 401. As a result, as the upstream abutting part 511 and the downstream abutting part 512 of the guide unit 33 press the medal M against the second side wall surface 462 at the predetermined position B on the upstream side of the holding surface 211 to slightly suppress the movement of the medal M, it is possible to control the moving state of medals M and improve the measurement accuracy of the number of medals M supplied to the holding surface 211. After this, when the medals M pass through the predetermined position B, the downstream abutting part 512 retracts to the outside of the first medal passage part 401, and accordingly, the load on the medals M is released and the medals M are allowed to move such that the supplying speed of the medals M can be maintained. As a result, it becomes possible to obtain the medal arrangement device 5 capable of stably and quickly supplying and disposing the medals M. Further, the occupying area of the configuration in which the second medal passage part 402 of the medal passage 400 are disposed on the holding surface 211 is less than that of the configuration in which the second medal passage part 402 of the medal passage 400 are disposed around the holding surface 211, and thus, miniaturization and simplification of the medal arrangement device 5 can be realized. Accordingly, it is possible to obtain the medal arrangement device 5 that can realize miniaturization while reducing the costs.

Further, in the medal arrangement device 5 according to the above-described embodiment, the downstream abutting part 512 can be interlocked with the movement in the width direction of the first medal passage part 401 of the upstream abutting part 511. As a result, the operation of the upstream abutting part 511 and the downstream abutting part 512 can be easily controlled.

In addition, in the medal arrangement device 5 according to the above-described embodiment, the guide unit 33 has the first guider 50, the first guider 50 has the first abutting part 51 having a lever structure, the first abutting part 51 has the fulcrum 513 fixed to the first side wall surface 461 side of the first medal passage part 401 and the downstream free end 514 provided on the downstream end portion 405 side, the upstream abutting part 511 and the downstream abutting part 512 are provided at the downstream free end 514 of the first abutting part 51, and the downstream abutting part 512 is provided so as to rotate around the fulcrum 513 in a direction away from the first medal passage part 401 or a direction approaching the first medal passage part 401 as a position where the upstream abutting part 511 contacts a side surface of the medal M changes. As a result, it is possible to control the operation of the downstream abutting part 512 by using a simple configuration.

In addition, in the medal arrangement device 5 according to the above-described embodiment, the upstream abutting part 511 and the downstream abutting part 512 are configured with rollers, and a shortest distance between the upstream abutting part 511 and the downstream abutting part 512 is less than a diameter of one medal M. As a result, the frictional force when the upstream abutting part 511 and the downstream abutting part 512 abut against the medal M can be reduced, and the movement of the medal M can be reliably suppressed at the predetermined position B.

Further, in the medal arrangement device 5 according to the above-described embodiment, the second medal passage part 402 is an annular passage part formed along the circumferential direction of the holding surface 211, and the medal M can be disposed on the holding surface 211 while filling the second medal passage part 402. As a result, the holding surface 211 can configure a part of the second medal passage part 402, and thus, the configuration of the second medal passage part 402 can be simplified.

In addition, in the medal arrangement device 5 according to the above-described embodiment, the guide unit 33 further has the second guider 55 which is provided at a center of the holding surface 211 so as to intersect the holding surface 311 and guides the medals M so as to define a traveling direction of the medal M in the second medal passage part 402. As a result, the traveling direction of the medals M in the second medal passage part 402 which is the annular passage part can be defined (for example, defined as the clockwise direction) by the second guider 55, and thus, the traveling of the medals M in different directions in the second medal passage part 402 can be suppressed. Therefore, the medals M can stably fill the second medal passage part 402.

In addition, in the medal arrangement device 5 according to the above-described embodiment, the second guider 55 has the protrusion 48 provided in the second medal passage part 402 so as to face the downstream end portion 405 of the first medal passage part 401, and a distance between the tip end of the protrusion 48 and the most downstream end of the first side wall surface 461 is equal to or greater than the diameter of one medal M, and a distance between the tip end of the protrusion 48 and the most downstream end of the second side wall surface 462 is less than the diameter of one medal M. As a result, it is possible to define the traveling direction of the medals M in the second medal passage part 402 by using a simple configuration.

In addition, in the medal arrangement device 5 according to the above-described embodiment, the guide unit 33 further has the third guider 60 having the first link 611 and the second link 621, which are examples of a guide plate, provided above the second medal passage part 402 so as to cover at least a part of the second medal passage part 402, and a distance between the surface of the first link 611 and the second link 621 facing the holding surface 211 and the holding surface 211 is greater than the thickness of one medal M and less than the thickness of two medals M. As a result, it is possible to suppress occurrence of clogging of the medals M in the second medal passage part 402 by restricting the movement of the medals M in the thickness direction during the movement.

In addition, in the medal arrangement device 5 according to the above-described embodiment, the guide unit 33 further has the guide actuator 65 that moves the third guider 60 in a range from a position where the guide unit 33 covers the second medal passage part 402 to a position where the guide unit 33 does not cover the second medal passage part 402. As a result, it is possible to adjust the position of the third guider 60 with respect to the second medal passage part 402 as necessary, and to improve the degree of freedom in using the third guider 60.

In addition, in the medal arrangement device 5 according to the above-described embodiment, the mounter 10 having the mounting surface 111 on which the medal tower MT configured with the single-layer medal set MS and the plural layers of single-layer medal sets MS are mounted; and the transporter 20 that raises and lowers the holder 21 in a range from the third position P3 above the mounting surface 111 to the first position P1 below the first medal passage part 401, are further provided. As a result, the medal tower MT can be formed and mounted by using a simple configuration.

The medal game machine 1 according to the above-described embodiment includes:

the medal feeder 2 for feeding medals; the mounting table 4 on which the medals fed are mounted; the pusher table 7 for moving the medals M mounted on the mounting table 4; the winning port 8 for the medals M dropped from the mounting table 4 entering; and any one of the above-described medal arrangement devices 5 provided on the mounting table 4. As a result, it becomes possible to provide the medal game machine 1 capable of stably and quickly supplying and disposing the medals M and reducing the costs.

The present invention is not limited to each of the above-described embodiments, and those embodiments which were appropriately modified by a person skilled in the art are also within the scope of the present invention as long as the modifications have the features of the present invention. In other words, each element, the disposition, material, condition, shape, size, and the like included in each of the above-described embodiments are not limited to those exemplified, and can be appropriately changed. In addition, each element included in each of the above-described embodiments can be combined as much as technically possible, and the combination of the elements is also included in the scope of the present invention as long as the features of the present invention are included.

REFERENCE SIGNS LIST

1 medal game machine
5 medal arrangement device
10 mounter
20 transporter
21 holder
22 lift table
23 lift crank
30 supplier
31 attaching unit
32 medal hopper
33 guide unit
50 first guider
51 first abutting part
55 second guider
60 third guider

65 guide actuator
70 collector
80 control unit
90 housing
211 holding surface
400 medal passage
401 first medal passage part
402 second medal passage part
405 downstream end portion
461 first side wall surface
462 second side wall surface
511 upstream abutting part
512 downstream abutting part
M medal
MS single-layer medal set
MT medal tower

What is claimed is:

1. A medal arrangement device comprising:

a holder having a holding surface for holding a single-layer medal set configured with a plurality of medals disposed in a predetermined arrangement; and a supplier supplying the medals to the holding surface via a medal passage, wherein the supplier has a medal hopper ejecting the medals one by one into the medal passage, and a guide unit guiding the medals ejected into the medal passage, wherein the medal passage has a first medal passage part formed on an upstream side of the holding surface in a moving direction of the medal and having a first side wall surface and a second side wall surface facing each other, and a second medal passage part connected to a downstream end portion of the first medal passage part and formed on the holding surface, wherein the guide unit has an upstream abutting part and a downstream abutting part, wherein both the upstream abutting part and the downstream abutting part are movable and are provided on a first side wall surface side of the first medal passage part so as to be urged toward the second side wall surface, and wherein the upstream abutting part and the downstream abutting part are provided so that: when one medal ejected from the medal hopper reaches a predetermined position of the downstream end portion, at least a part of the upstream abutting part and at least a part of the downstream abutting part are located in the first medal passage part so as to press the medal against the second side wall surface; and when the medal passes through the predetermined position, the downstream abutting part retracts to an outside of the first medal passage part.

2. The medal arrangement device according to claim 1, wherein the downstream abutting part is interlocked with movement in a width direction of the first medal passage part of the upstream abutting part.

3. The medal arrangement device according to claim 1, wherein the guide unit has a first guider, wherein the first guider has a first abutting part having a lever structure, wherein the first abutting part has a fulcrum fixed to the first side wall surface side of the first medal passage part and a downstream free end provided on a downstream end portion side, wherein the upstream abutting part and the downstream abutting part are provided at the downstream free end of the first abutting part, and wherein the downstream abutting part is provided so as to rotate around the fulcrum in a direction away from the first medal passage part or a direction approaching the first medal passage part as a position where the upstream abutting part abuts against a side surface of a medal changes.

4. The medal arrangement device according to claim 3, wherein the guide unit further has a second guider which is provided at a center of the holding surface intersecting the holding surface and guides the medals so as to define a traveling direction of the medals in the annular passage part.

5. The medal arrangement device according to claim 4, wherein the second guider has a protrusion provided in the annular passage part toward the downstream end portion of the first medal passage part, and wherein a distance between a tip end of the protrusion and a most downstream end of the first side wall surface is equal to or greater than a diameter of one medal, and a distance between the tip end of the protrusion and a most downstream end of the second side wall surface is less than the diameter of one medal.

6. The medal arrangement device according to claim 4, wherein the guide unit further has a third guider having a guide plate, wherein the guide plate is provided above the second medal passage part so as to cover at least a part of the second medal passage part, and wherein a distance between the holding surface and a surface of the guide plate facing the holding surface is greater than a thickness of one medal and less than a thickness of two medals.

7. The medal arrangement device according to claim 6, wherein the guide unit further has an actuator moving the third guider in a range from a position where the third guider covers the second medal passage part to a position where the third guider does not cover the second medal passage part.

8. The medal arrangement device according to claim 1, wherein both the upstream abutting part and the downstream abutting part are configured with rollers, and wherein a shortest distance between the upstream abutting part and the downstream abutting part is less than a diameter of one medal.

9. The medal arrangement device according to claim 1, wherein the second medal passage part is an annular passage part formed along a circumferential direction of the holding surface, and wherein the medals are disposed on the holding surface while filling the annular passage part.

10. The medal arrangement device according to claim 1, further comprising:

a mounter having a mounting surface on which the single-layer medal set or a medal tower configured with plural layers of the single-layer medal sets is mounted; and a transporter raising or lowering the holder in a range from a position above the mounting surface to a position below the first medal passage part.

11. A medal game machine comprising:

a medal feeder feeding medals;

a mounting table on which the medals fed by the medal feeder are mounted;

a pusher table moving the medals mounted on the mounting table;

a winning port for the medals dropped from the mounting table entering; and the medal arrangement device according to claim 1 configured to be disposed inside the mounting table and arrange medals to be exposed from the mounting table.

* * * * *